US010071588B2

(12) United States Patent
Abe

(10) Patent No.: US 10,071,588 B2
(45) Date of Patent: Sep. 11, 2018

(54) SHEET PROCESSING APPARATUS AND IMAGE FORMING APPARATUS

(71) Applicant: CANON KABUSHIKI KAISHA, Tokyo (JP)

(72) Inventor: Hideto Abe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 151 days.

(21) Appl. No.: 15/001,725

(22) Filed: Jan. 20, 2016

(65) Prior Publication Data

US 2016/0136917 A1 May 19, 2016

Related U.S. Application Data

(63) Continuation of application No. 14/315,836, filed on Jun. 26, 2014, now Pat. No. 9,278,571.

(30) Foreign Application Priority Data

Jul. 1, 2013 (JP) ..... 2013-138108

(51) Int. Cl.

| | |
|---|---|
| ***B42B 5/00*** | (2006.01) |
| ***B65H 9/06*** | (2006.01) |
| ***B65H 31/34*** | (2006.01) |
| ***B65H 43/04*** | (2006.01) |
| ***B31F 5/02*** | (2006.01) |

(Continued)

(52) U.S. Cl.

CPC ..... *B42B 5/00* (2013.01); *B31F 1/07* (2013.01); *B31F 5/02* (2013.01); *B65H 9/04* (2013.01); *B65H 9/06* (2013.01); *B65H 31/34* (2013.01); *B65H 37/04* (2013.01); *B65H 43/04* (2013.01); *B31F 2201/0712* (2013.01); *B65H 2301/51616* (2013.01); *G03G 2215/00852* (2013.01)

(58) Field of Classification Search

CPC ... G03G 2215/00852; B31F 5/02; B31F 1/07; B31F 2201/0712; B42F 3/003; B65H 2301/51616; B65H 9/04; B65H 31/34

USPC ..... 270/58.07, 58.08, 58.11, 58.12, 58.17, 270/58.27; 412/33

See application file for complete search history.

(56) References Cited

U.S. PATENT DOCUMENTS

| | | | |
|---|---|---|---|
| 6,290,220 | B1 | 9/2001 | Takehara et al. |
| 6,814,350 | B2 | 11/2004 | Saegusa et al. |

(Continued)

FOREIGN PATENT DOCUMENTS

| | | | |
|---|---|---|---|
| JP | 2010-189101 | A | 9/2010 |
| JP | 2014-73681 | A | 4/2014 |

OTHER PUBLICATIONS

Office Action dated Mar. 13, 2018, in Japanese Patent Application No. 2014-124927.

*Primary Examiner* — Leslie A Nicholson, III

(74) *Attorney, Agent, or Firm* — Fitzpatrick, Cella, Harper & Scinto

(57) ABSTRACT

A sheet processing apparatus includes a binding portion binding a plurality of sheets stacked on a sheet stacking portion as a bundle by deforming the sheets without a staple. The sheet processing apparatus further includes a moving member moving the sheet bundle bound at a binding position by the binding portion from the binding position and a restricting member restricting the move of the sheet bundle such that a distance between the sheet bundle and the moving member is kept to be less than a predetermined distance in moving the sheet bundle by the moving member.

12 Claims, 17 Drawing Sheets

(51) Int. Cl.

| | |
|---|---|
| ***B31F 1/07*** | (2006.01) |
| ***B65H 9/04*** | (2006.01) |
| ***B65H 37/04*** | (2006.01) |

(56) References Cited

U.S. PATENT DOCUMENTS

| | | | | |
|---|---|---|---|---|
| 7,207,556 | B2 * | 4/2007 | Saitoh | B65H 31/40 227/110 |
| 7,413,181 | B2 | 8/2008 | Iida et al. | |
| 8,235,375 | B2 | 8/2012 | Shiraishi | |
| 8,246,033 | B2 * | 8/2012 | Sato | B42C 1/12 270/58.07 |
| 8,297,610 | B2 * | 10/2012 | Shiraishi | B65H 37/04 270/58.08 |
| 8,342,497 | B2 | 1/2013 | Abe | |
| 8,444,133 | B2 | 5/2013 | Kimura | |
| 8,459,629 | B2 | 6/2013 | Abe | |
| 8,882,100 | B2 | 11/2014 | Awano | |
| 2011/0304089 | A1 | 12/2011 | Kimura | |
| 2012/0090441 | A1 | 4/2012 | Abe | |
| 2013/0285303 | A1 | 10/2013 | Awano | |
| 2014/0003852 | A1 | 1/2014 | Abe et al. | |
| 2014/0077437 | A1 | 3/2014 | Abe et al. | |
| 2014/0161565 | A1 | 6/2014 | Obuchi et al. | |

* cited by examiner

SHEET PROCESSING APPARATUS AND IMAGE FORMING APPARATUS

This is a continuation of U.S. patent application Ser. No. 14/315,836, filed Jun. 26, 2014.

BACKGROUND OF THE INVENTION

Field of the Invention

The present invention relates to a sheet processing apparatus capable of binding a sheet bundle and an image forming apparatus including the same.

Description of the Related Art

Heretofore, there is known an image forming apparatus such as a copier, a printer, a facsimile, and a multi-function printer including a sheet processing apparatus configured to bind a plurality of sheets (sheet bundle) on which images have been formed. Many of the sheet processing apparatuses provided in the image forming apparatus is configured to bind a sheet bundle by using metallic staples. It is because the sheet processing apparatus using the metallic staples can bind the sheet bundle securely at a positioned specified by a user.

However, the sheet bundle bound by the metallic staples necessitates the staples to be removed from the sheet bundle in putting through a shredder or in recycling the sheets. It is a cumbersome work to remove the staples from the sheet bundle, and the removed staples become waste, so that it is costly to use staples as a whole. Then, lately, there is proposed a sheet processing apparatus configured to bind sheets by entangling fibers of the sheets by forming convexities and concavities in a direction of a thickness of the sheet bundle and by joining the sheets with each other (referred to as 'staple-less biding' hereinafter) as disclosed in Japanese Patent Application Laid-open NO. 2010-189101.

Here, the sheet processing apparatus described in Japanese Patent Application Laid-open No. 2010-189101 is configured to form the convexities and concavities on the sheet bundle by a pair of tooth-shaped members having upper and lower teeth and to release the bound sheet bundle by moving the upper and lower teeth in directions separating from each other by a compression spring. Therefore, there is a possibility that either one of the upper and lower teeth bites into the sheet, and the sheet may stick to the teeth if an engagement force of the upper and lower teeth is increased. It is because the sheet bundle bites into the teeth and a wedge condition is brought about as the fibers of the compressed sheets get into fine cut steps formed in creating the teeth.

Here, in a case where the bounded sheet bundle is tried to be conveyed by pushing an end portion thereof by a press member, the sheet bundle deflects between a part biting with either one of the upper and lower teeth and the part pressed by a press member. Then, while the sheet bundle is peeled off from either one of the upper and lower teeth and starts to move by being pushed by the press member, there is a possibility that the sheet bundle jumps out as the deflection caused in the sheet bundle is released at once.

SUMMARY OF THE INVENTION

According to an aspect of the present invention, a sheet processing apparatus includes a sheet stacking portion on which sheets are stacked, a binding portion binding a plurality of sheets stacked on the sheet stacking portion as a bundle by deforming the sheets without a staple, a moving member moving the sheet bundle bound at a binding position by the binding portion from the binding position, and a restricting member restricting the move of the bound sheet bundle such that a distance between the bound sheet bundle and the moving member is kept to be less than a predetermined distance in moving the bound sheet bundle by the moving member.

Further features of the present invention will become apparent from the following description of exemplary embodiments with reference to the attached drawings.

DESCRIPTION OF THE EMBODIMENTS

An image forming apparatus including a sheet processing apparatus according to embodiments of the present invention will be described with reference to the drawings. The image forming apparatus of the embodiments of the present invention is an image forming apparatus including a finisher as a sheet processing apparatus capable of binding a plurality of sheets (a sheet bundle) such as a copier, a printer, a facsimile, and a multi-function printer. The following embodiments will be explained by using an electro-photographic image forming apparatus.

First Embodiment

Figure 1:
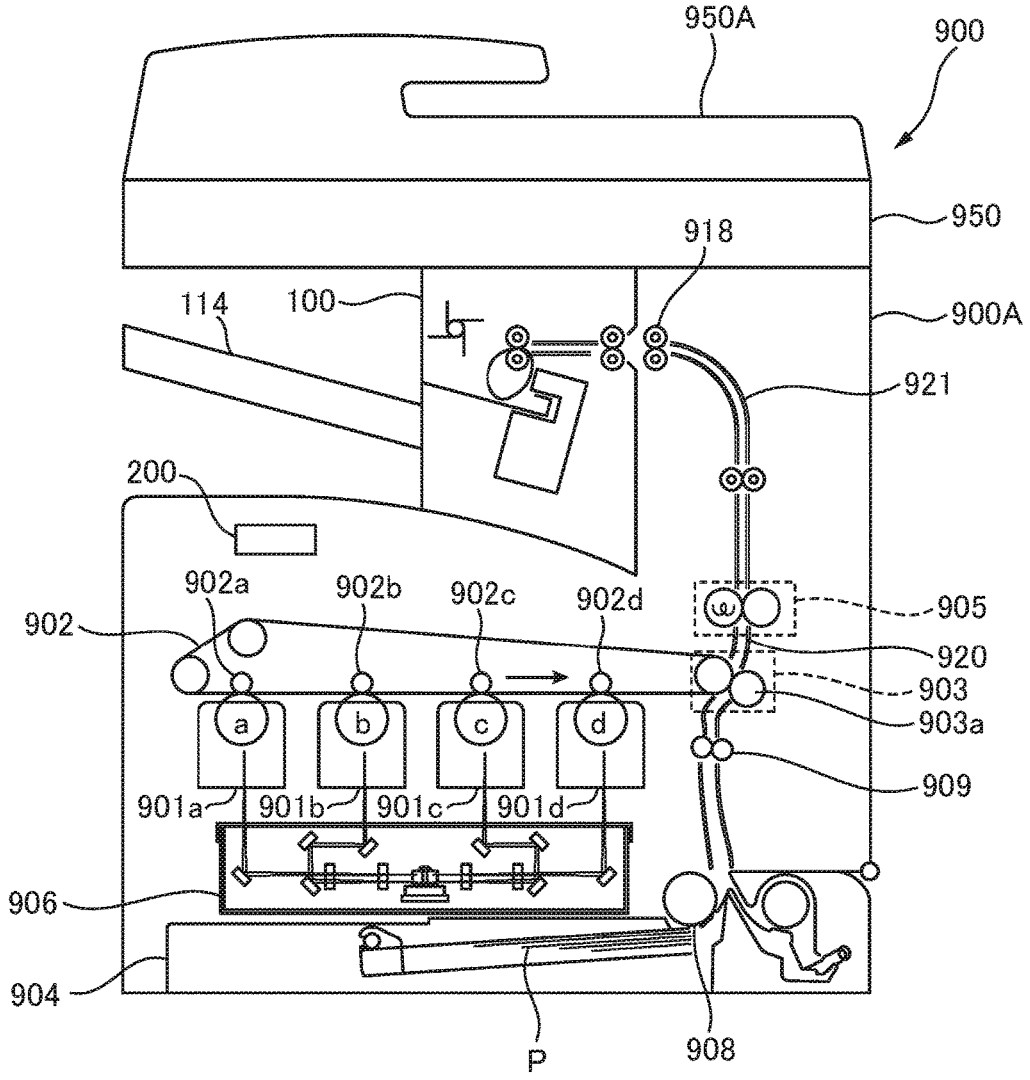
FIG. 1 is a schematic diagram illustrating a configuration of an image forming apparatus according to a first embodiment of the present invention.

An image forming apparatus 900 of a first embodiment will be explained with reference to FIGS. 1 through 12. A schematic configuration of the image forming apparatus 900 will be explained at first with reference to FIG. 1. FIG. 1 is a schematic diagram showing a configuration of the image forming apparatus 900 of the first embodiment of the present invention.

As shown in FIG. 1, the image forming apparatus 900 includes a body of the image forming apparatus (referred to simply as an 'apparatus body' hereinafter) 900A configured to form an image on a sheet P, an image reading apparatus 950 capable of reading an image of a document, and a finisher 100, i.e., a sheet processing apparatus. In the present embodiment, the image reading apparatus 950 includes a document feeder 950A capable of automatically feeding a document, and the finisher 100 is disposed between an upper surface of the apparatus body 900A and the image reading apparatus 950.

The apparatus body 900A includes photoconductive drums a through d configured to form toner images of each color of yellow, magenta, cyan, and black, and an intermediate transfer belt 902 carrying the toner images formed and transferred from the photoconductive drums a through d. The photoconductive drums a through d are configured to be rotationally driven by motors not shown. Disposed around each of the photoconductive drums are a primary charging unit, a developer, and a transfer charging unit not shown. Each of the photoconductive drums, the primary charging unit, the developer, and the transfer charging unit are unitized as process cartridge 901*a* through 901*d*, respectively, and are configured to be removable from the apparatus body 900A. An exposure unit 906 composed of a polygonal mirror and others is disposed under the photoconductive drums a through d.

When an image of a document is read by the image reading apparatus 950 for example, a laser beam of yellow which is a component color of the document is irradiated to the photoconductive drum a through the polygonal mirror and others of the exposure unit 906, and an electrostatic latent image is formed on the photoconductive drum a. Then, the electrostatic latent image is visualized as a yellow toner image by supplying yellow toner from the developer to the electrostatic latent image on the photoconductive drum a. When the photoconductive drum a rotates and comes to the primary transfer portion where the drum comes into contact with the intermediate transfer belt 902, the yellow toner image on the photoconductive drum a is transferred to the intermediate transfer belt 902 by a primary transfer bias applied to the transfer charging member 902*a*.

When the part of the intermediate transfer belt 902 carrying the yellow toner image moves in a direction indicated by an arrow in FIG. 1, a magenta toner image which has been formed on the photoconductive drum b by the same method described above until then is superimposed and transferred to the intermediate transfer belt 902 on the yellow toner image. In the same manner, as the intermediate transfer belt 902 moves, a cyan toner image formed on the photoconductive drum c and a black toner image formed on the photoconductive drum d are superimposed and transferred, and thus the four color toner images are transferred on the intermediate transfer belt 902.

Meanwhile, the sheet P on which the image is to be formed is stored in a cassette 904 provided at a lower part of the apparatus body 900A and is fed one by one from the cassette 904 by a pickup roller 908. The sheet P thus fed out by the pickup roller 908 is synchronized by a registration roller 909 and reaches a second transfer portion 903. Then, the four color toner images on the intermediate transfer belt 902 are transferred collectively to the sheet P by a secondary transfer roller 903*a* to which a secondary transfer bias is applied.

The sheet P on which the four color toner images have been transferred is conveyed to a fixing roller pair 905 by being guided through a conveyance guide 920. Then, the respective color toners melt and mix by receiving heat and pressure from the fixing roller pair 905 and the toner images are fixed as a full-color print image. The sheet P on which the image has been fixed is conveyed to the finisher 100 by passing through a conveyance guide 921 and by a discharge roller pair 918.

The finisher 100 is configured to take in the sheet P discharged out of the apparatus body 900A one by one, to align and bundle the plurality of sheets thus taken in as one bundle, and to perform a binding process (post-processing) of binding an upstream end (referred to as 'rear end' hereinafter) in a conveying direction of the bundled sheet bundle. It is noted that the finisher 100 will be described in detail later.

The sheet P on which the post-processing has been performed by the finisher 100 is discharged out of the apparatus and is stacked on a stacking tray 114. In a case where no post-processing needs to be done by the finisher 100, the sheet P conveyed to the finisher 100 is discharged out of the apparatus by passing through the finisher 100 and is stacked on the stacking tray 114.

Figure 2:
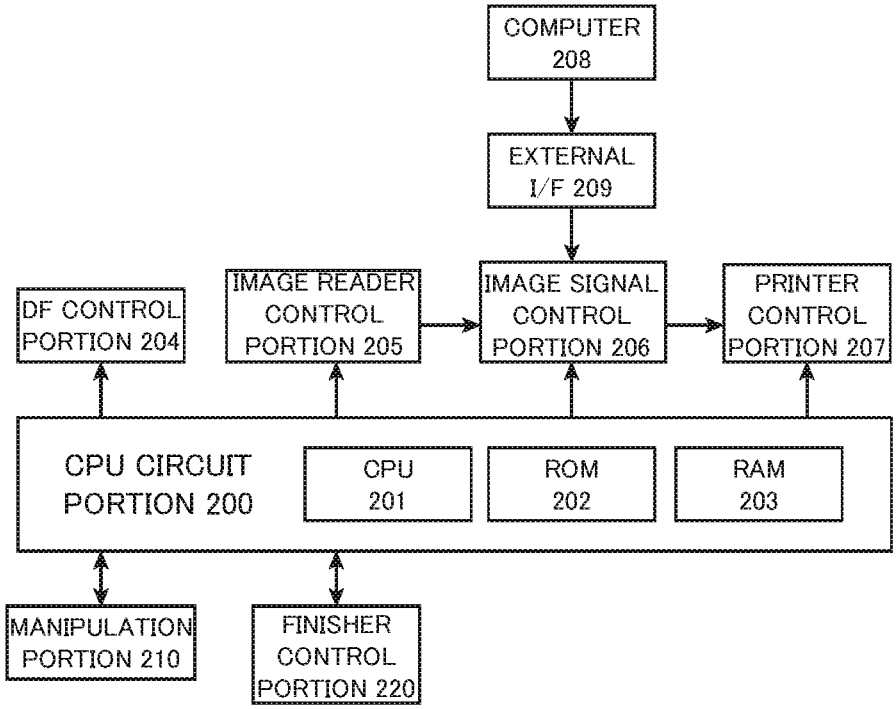
FIG. 2 is a control block diagram of a controller of the image forming apparatus of the first embodiment.
Figure 3:
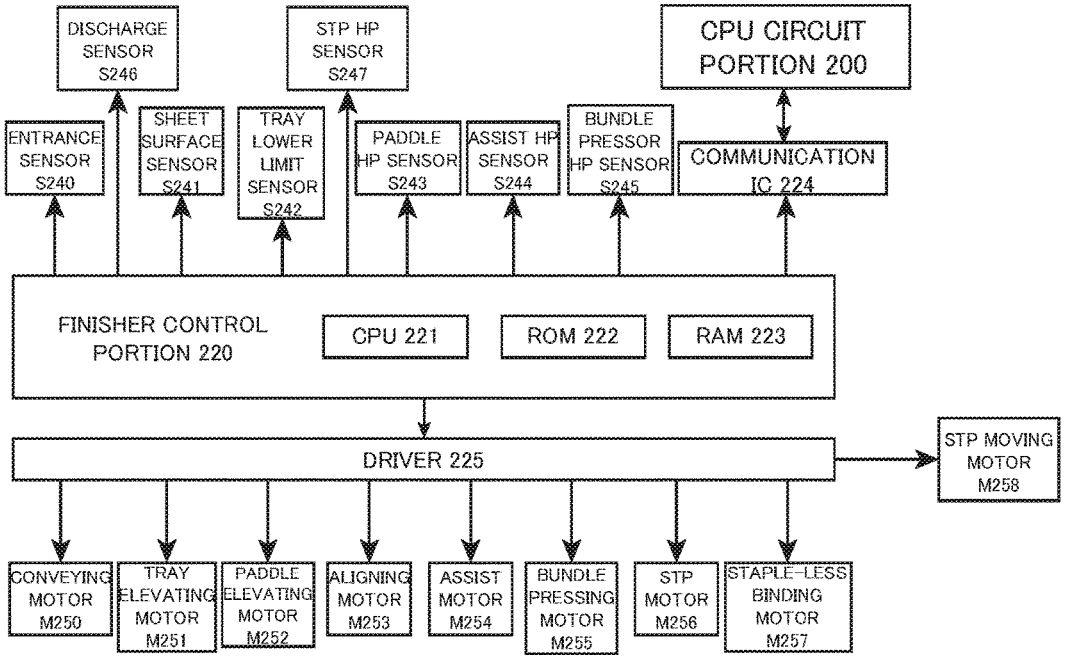
FIG. 3 is a control block diagram of a finisher control portion of the first embodiment.

Next, a configuration of a controller controlling the image forming apparatus 900 will be explained with reference to FIGS. 2 and 3. FIG. 2 is a control block diagram of the controller of the image forming apparatus 900 of the present embodiment, and FIG. 3 is a control block diagram of a finisher control portion 220 of the present embodiment.

As shown in FIG. 2, the controller includes a CPU circuit portion 200, and the CPU circuit portion 200 includes a CPU 201, a ROM 202, and a RAM 203. The ROM 202 stores control programs and others, and the RAM 203 is used as an area for temporarily holding control data or as a work area for calculation involved in the control.

Based on the control program stored in the ROM 202, the CPU circuit portion 200 integrally controls a DF (document feeder) control portion 204, an image reader control portion 205, an image signal control portion 206, a printer control portion 207, and the finisher control portion 220. Based on an instruction from the CPU circuit portion 200, the DF control portion 204 drives and controls the document feeder 950A. The image reader control portion 205 drives and controls a scanner unit, an imaging unit and others of the image reading apparatus 950 and transfers an analog image signal outputted from an image sensor to the image signal control portion 206 based on an instruction from the CPU circuit portion 200.

The image signal control portion 206 converts the analog image signal outputted of the image sensor into a digital signal. The image signal control portion 206 also converts the digital signal into a video signal and outputs it to the printer control portion 207. In a case where a digital image signal is inputted to the image signal control portion 206 from a computer 208 through an external I/F 209, the image signal control portion 206 converts the digital image signal thus inputted into a video signal and outputs it to the printer control portion 207. It is noted that the processing operation of the image signal control portion 206 is controlled by the CPU circuit portion 200. Based on the video signal thus inputted, the printer control portion 207 drives and controls the apparatus body 900A (exposure unit and others described above).

A manipulation portion 210 includes a plurality of keys used in setting various functions in forming an image and a display indicating a state thus set, and outputs key signals corresponding to each key thus manipulated to the CPU circuit portion 200 and displays information corresponding to signals from the CPU circuit portion 200 on the display. The finisher control portion 220 is mounted in the finisher 100 and drives and controls the entire finisher 100 by exchanging information with the CPU circuit portion 200.

As shown in FIG. 3, the finisher control portion 220 includes a CPU 221, a ROM 222 storing a control programs and others, a RAM 223 used as an area for temporarily holding control data and a work area of calculations involved in the control. The finisher control portion 220 exchanges data with the CPU circuit portion 200 through a communication IC 224 and executes various programs stored in the ROM 222 on a basis of an instruction from the CPU circuit portion 200 to drive and controls the finisher 100.

For instance, based signals inputted from various sensors of the finisher 100, the finisher control portion 220 drives and controls various motors of the finisher 100 through a driver 225. The various sensors include an entrance sensor S240, a sheet surface sensor S241, a tray lower limit sensor S242, a paddle HP sensor S243, a assist HP sensor S244, a bundle pressor HP sensor S245, a discharge sensor S246, a STPHP sensor S247 and others. The various motors include a conveying motor M250, a tray elevating motor M251, a paddle elevating motor M252, a aligning motor M253, a assist motor M254, a bundle pressing motor M255, a STP motor M256, a staple-less binding motor M257, a STP moving motor M258, and others.

Next, the finisher 100 described above will be explained in detail with reference to FIGS. 4 through 12. A schematic configuration of the finisher 100 will be explained along a move of the sheet P with reference to FIGS. 4 and 5. FIGS. 4 and 5 are section views illustrating the finisher 100 of the present embodiment.

Figure 4A:
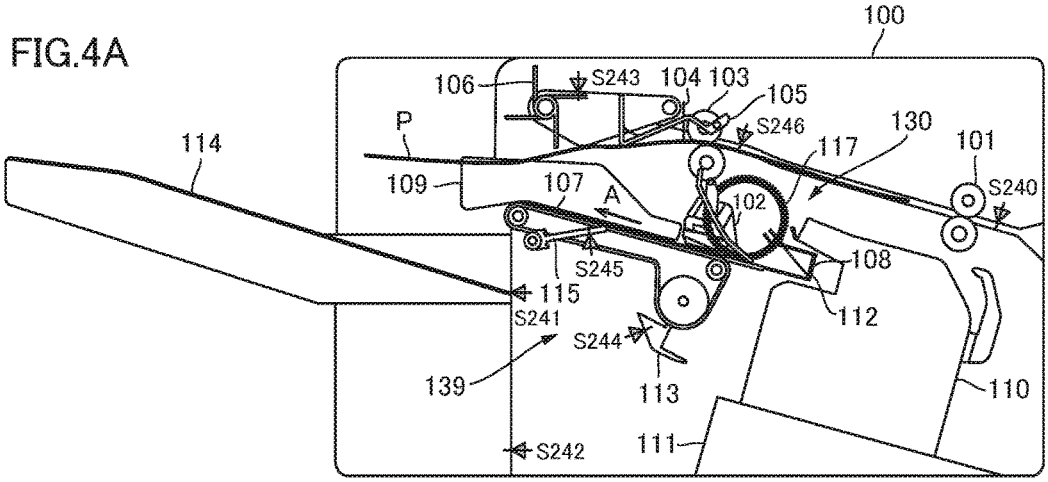
FIG. 4A is a section view illustrating a finisher of the first embodiment in which a sheet P is conveyed to the finisher.

As shown in FIG. 4A, the sheet P discharged out of the apparatus body 900A is passed to the entrance roller 101 driven by the conveying motor M250 and is conveyed to a conveying path by the entrance roller 101. At this time, the entrance sensor S240 detects the sheet P passed to the entrance roller 101. After that, the sheet P moving through the conveying path is passed to the discharge roller 103. Then, the sheet P is conveyed to a processing tray (sheet stacking portion) 107 while lifting a rear end drop 105 by its front end portion, while being conveyed by the discharge roller 103 and while being destaticized by a destaticizing needle 104.

At this time, the discharge sensor S246 provided upstream in the conveying direction of the discharge roller 103 detects the sheet P discharged to the processing tray 107, and based on a detection signal of this time, the finisher control portion 220 controls the staple-less binding unit 102 and others described later. It is noted that a falling time of the sheet P discharged by the discharge roller 103 to the processing tray 107 is shortened by pressing the sheet P from above by the rear end drop 105.

Figure 4B:
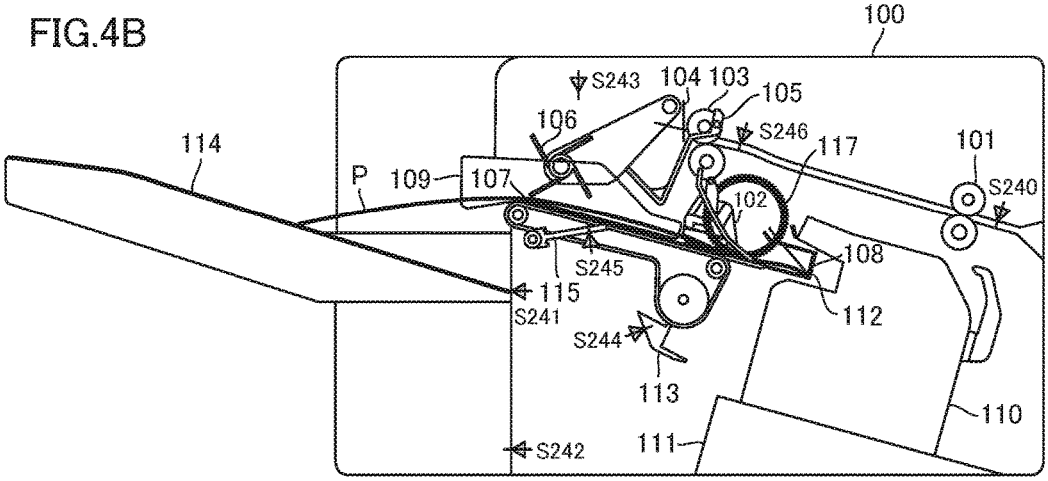
FIG. 4B is a section view illustrating a finisher of the first embodiment in which the sheet P is returned so as to abut against a rear end stopper.

As shown in FIG. 4B, in response to a fall of the sheet P down to the processing tray 107, a paddle 106 is brought down to the processing tray 107 side centering on a rotational axis thereof by the paddle elevating motor M252. At this time, the paddle 106 rotates counterclockwise by the conveying motor M250 and the paddle 106 comes into contact with the sheet P, so that the sheet P is conveyed toward a rear end stopper 108 located at a right hand side in the finisher 100 in FIG. 4B. When a rear end of the sheet P is passed to a knurling belt (shift member) 117, the paddle elevating motor M252 is driven in an uplift direction and a paddle HP sensor detects HP (home position) of the paddle 106. Then, the drive of the paddle elevating motor M252 is stopped.

The knurling belt 117 urges the sheet P always to the rear end stopper 108 side by conveying, while slipping, the sheet P even after when the sheet P has been conveyed by the paddle 106 to the rear end stopper 108 restricting the rear edge of the sheet P. This slip conveyance enables the rear end of the sheet P to abut against the rear end stopper 108 and a skew of the sheet P to be corrected. The sheet P abutting against the rear end stopper 108 is aligned in a direction orthogonal to the conveying direction (referred to as a 'width direction' or 'moving direction' hereinafter) by a pair of aligning plates (pair of aligning members) 109 moved in the width direction by the aligning motor M253. A sheet bundle PA aligned on the processing tray 107 is thus formed by repeating this series of operations on the processing tray 107 (see FIG. 5A).

In a case where a stapling process is to be carried on the bundle PA formed by a predetermined number of sheets stacked on the processing tray 107, the STP motor M256 that drives a stapler 110 is driven, and the sheet bundle PA is then bound. Meanwhile, in a case a staple-less binding job is to be carried out on the sheet bundle PA, the pair of aligning plates 109 is moved in the direction orthogonal to the sheet conveying direction to move the sheet bundle PA thus aligned toward a staple-less binding position. Then, the staple-less binding motor M257 is driven to carry out the staple-less binding job by a staple-less binding unit (binding portion) 102. It is noted that the staple-less binding unit 102 will be described in detail later.

Figure 5A:
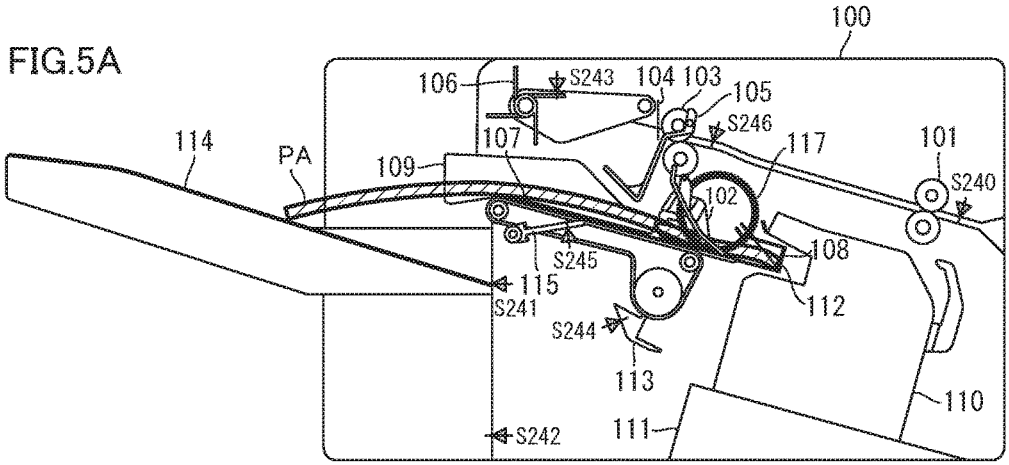
FIG. 5A is a section view illustrating the finisher of the first embodiment in a state in which a sheet bundle is formed on a processing tray.
Figure 5B:
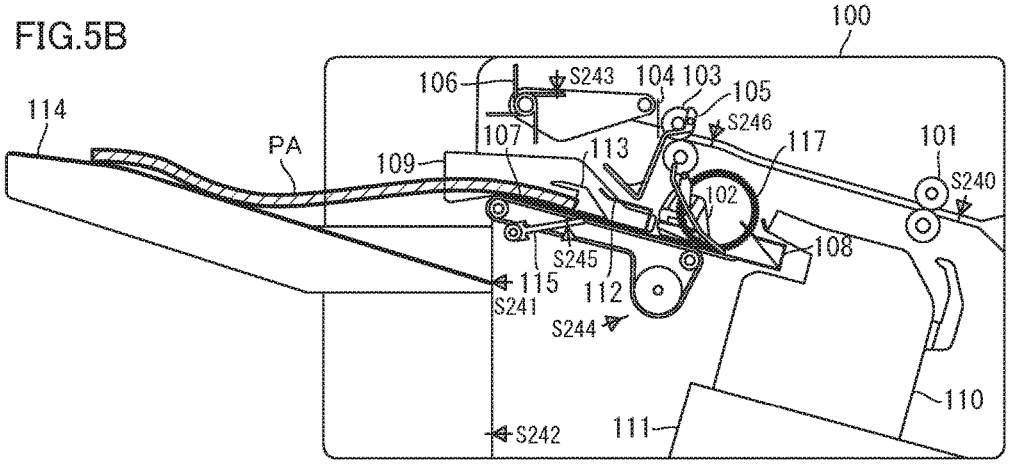
FIG. 5B is a section view illustrating the finisher of the first embodiment in a state in which the sheet bundle on the processing tray is discharged.
Figure 5C:
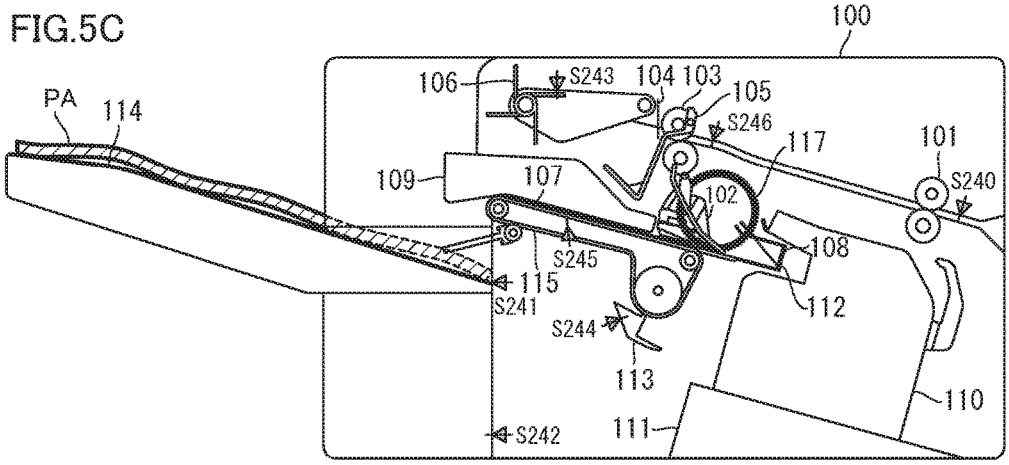
FIG. 5C is a section view illustrating the finisher of the first embodiment in a state in which the sheet bundle is discharged on a stacking tray.

Still further, in a case where no binding process is carried out on the sheet bundle PA, the aligned sheet bundle PA is discharged to the stacking tray 114 without carrying out any binding process. At this time, as shown in FIG. 5B, the sheet bundle PA on the processing tray 107 is discharged on the stacking tray 114 as the rear end of the sheet bundle PA is pushed by a rear end assist (restricting portion) 112 and a discharge claw 113 which are driven in the same manner by the assist motor M254. In order to prevent the sheet bundle PA from being pushed out in the conveying direction by a sheet bundle PA successively discharged on the stacking tray 114 as shown in FIG. 5C, a bundle pressor 115 is rotated counterclockwise by the bundle pressing motor M255 to press the rear end of the sheet bundle PA.

Then, in a case where the sheet bundle PA blocks the sheet surface sensor S241 after completing to press the rear end of the sheet bundle PA, the stacking tray 114 is lowered by the tray elevating motor M251 until when the sheet surface sensor S241 is put into a transmission state to determine a sheet level position.

A required number of sheet bundles can be discharged on the stacking tray 114 by performing the series of operations described above. Still further, in a case where the stacking tray 114 is lowered during the operation and the tray lower limit sensor S242 is blocked, i.e., the stacking tray 114 is fully loaded, a full-load signal is notified from the finisher control portion 220 to the CPU circuit portion 200 and the image forming operation is stopped. If the sheet bundles on the stacking tray 114 are removed after that, the stacking tray 114 is lifted until when the sheet surface sensor S241 is blocked and is then lowered and the sheet surface sensor S241 becomes transmissive. Thereby, the position of the stacking tray 114 is determined and the image forming operation is restarted.

Figure 6A:
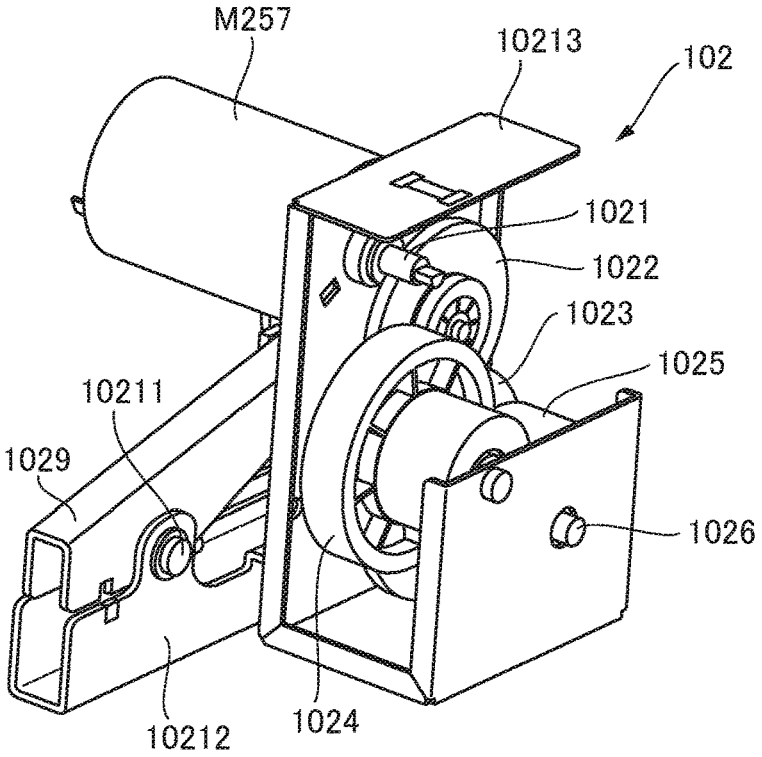
FIG. 6A is a perspective view showing a staple-less binding unit provided in the finisher.
Figure 6B:
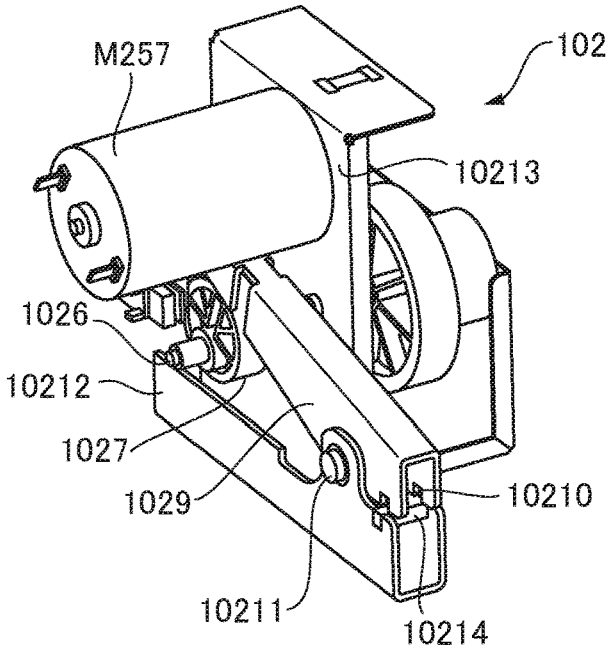
FIG. 6B is a perspective view showing the staple-less binding unit provided in the finisher and seen from an aspect different from that of FIG. 6A.
Figure 7A:
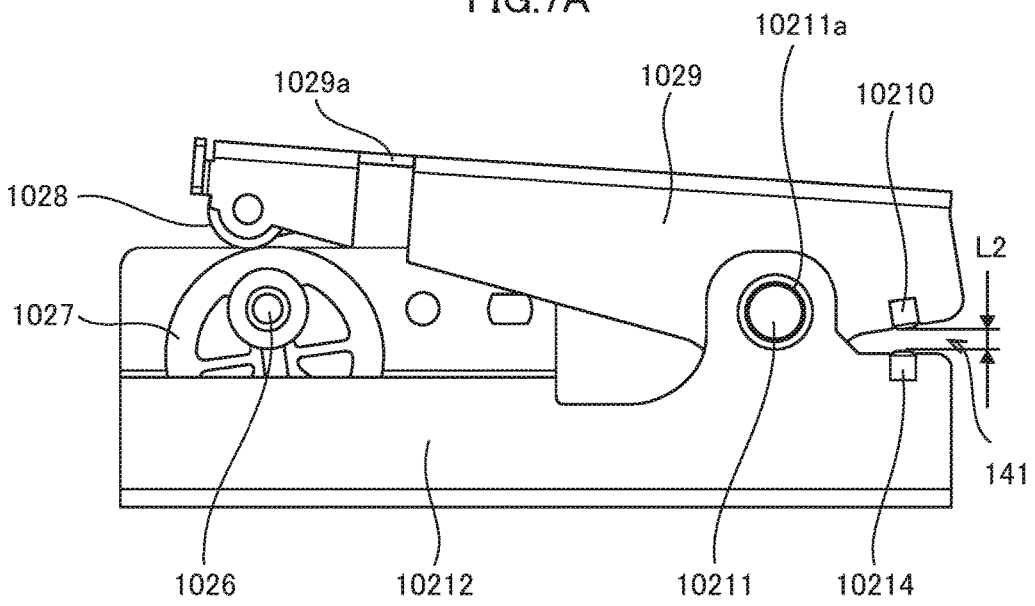
FIG. 7A is a front view of the staple-less binding unit in a state in which upper and lower teeth are not engaged.
Figure 7B:
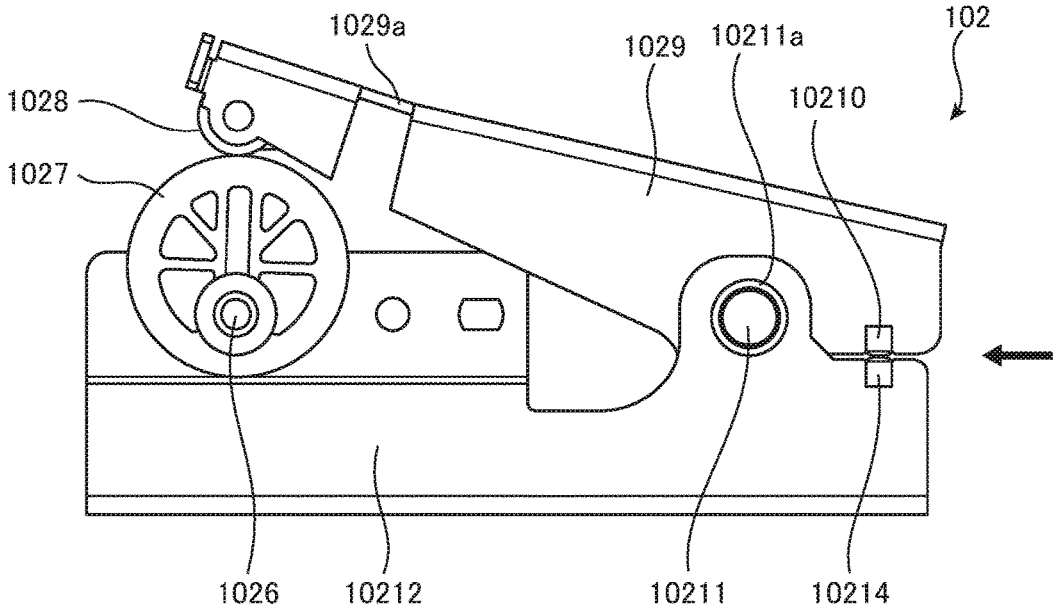
FIG. 7B is a front view of the staple-less binding unit in a state in which the upper and lower teeth are engaged.
Figure 8:
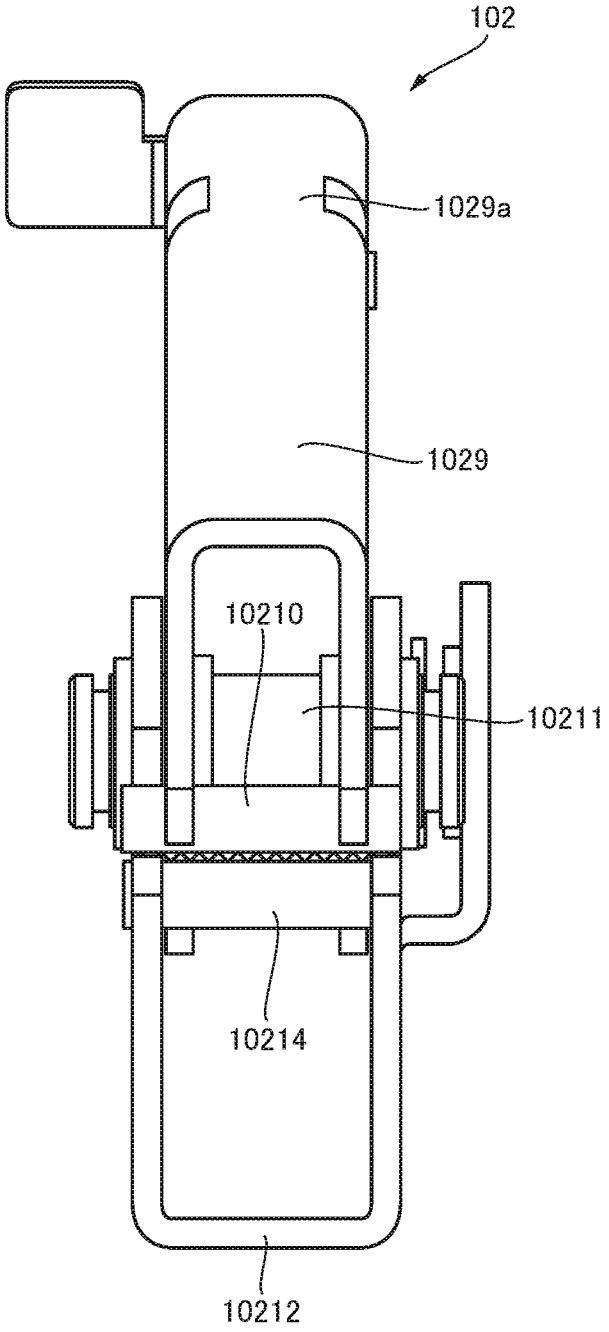
FIG. 8 is a view of the staple-less binding unit seen from a direction of an arrow shown in FIG. 7B.
Figure 9:
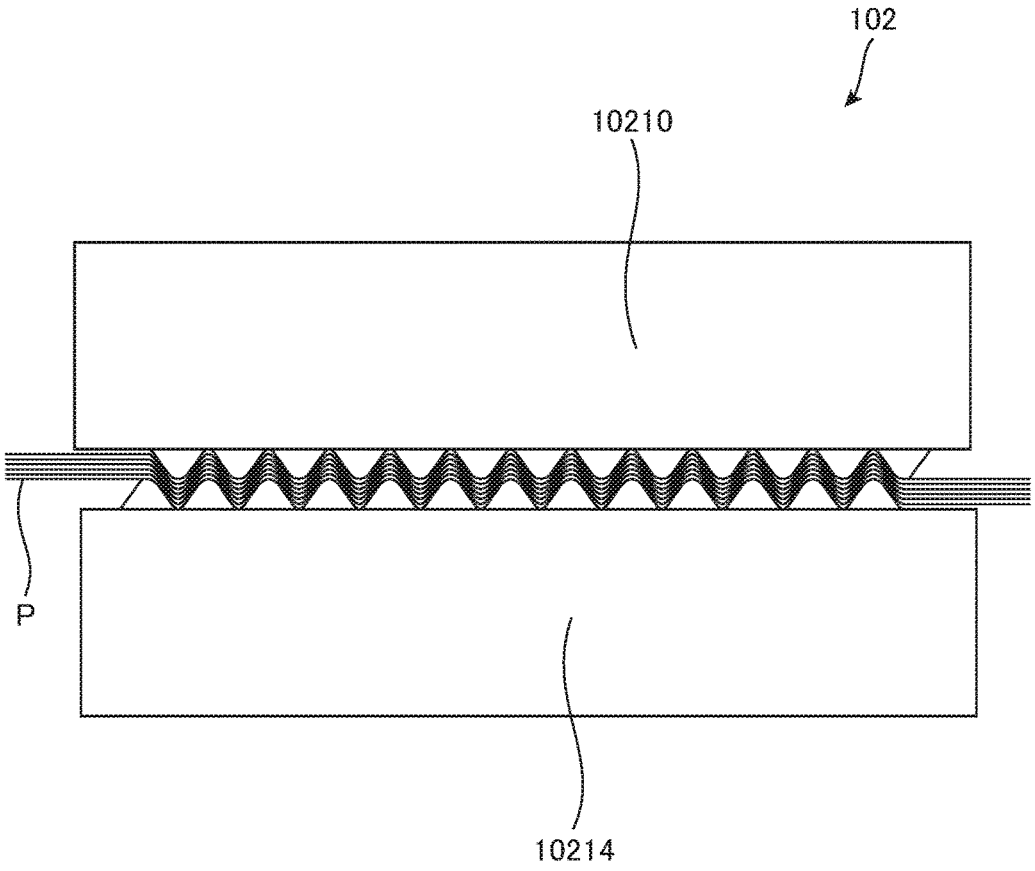
FIG. 9 is a partially enlarged view of the upper and lower teeth of the staple-less binding unit shown in FIG. 8.

Next, the staple-less binding unit 102 will be explained with reference to FIGS. 6 through 12. At first, a configuration of the staple-less binding unit 102 will be explained with reference to FIGS. 6 through 9. FIGS. 6A and 6B are perspective views of the staple-less binding unit 102 provided in the finisher 100, FIGS. 7A and 7B are front views of the staple-less binding unit 102 provided in the finisher 100, and FIG. 8 is a side view of the staple-less binding unit 102 seen from a direction of an arrow shown in FIG. 7B. FIG. 9 is a partially enlarged view of upper and lower teeth (first and second tooth portions) 10210 and 10214 of the staple-less binding unit 102 shown in FIG. 8.

As shown in FIGS. 6A and 6B, the staple-less binding unit 102 includes a staple-less binding motor M257, a gear 1021 rotated by the staple-less binding motor M257, stepped gears 1022 through 1024 rotated by the gear 1021. The staple-less binding unit 102 also includes a gear 1025 rotated by the stepped gears 1022 through 1024, and a lower arm 10212 fixed to a frame 10213. The staple-less binding unit 102 further includes an upper arm 1029 rockably attached to the lower arm 10212 centering on an axis 10211 and is biased toward the lower arm side by a bias member not shown.

The gear 1025 is attached to the rotational shaft 1026 and a cam 1027 is attached to the rotational shaft 1026. The cam 1027 is provided between the upper and lower arms 1029 and 10212. Thereby, when the staple-less binding motor M is rotated, the rotation of the staple-less binding motor M257 is transmitted to the rotational shaft 1026 through the gear 1021, the stepped gears 1022 through 1024 and the gear 1025. Then, the cam 1027 is rotated.

When the cam 1027 rotates, a cam side end portion of the upper arm 1029 which has been in pressure contact with the cam 1027 through the roller 1028 by a bias force of a torsion coil spring 10211*a*, i.e., a bias member, is lifted as shown in FIGS. 7A and 7B. Here, the upper teeth 10210 are attached at a lower end of an end portion opposite from the cam 1027 of the upper arm 1029, and the lower teeth 10214 are attached to an upper end of the end portion opposite from the cam 1027 of the lower arm 10212. As shown in FIGS. 8 and 9, the lower teeth 10214 and the upper teeth 10210 have a plurality of convexities and concavities, respectively.

The staple-less binding unit 102 is configured such that when the cam side end portion of the upper arm 1029 is lifted, the end portion on the side opposite from the cam 1027 of the upper arm 1029 drops and along with that, the upper teeth 10210 drop and engage with the lower teeth 10214, thus sandwiching and pressing the sheets (fibrous sheet) P. The sheet P is extended by being pressed as described above and fibers on a surface of the sheet P are exposed. The fibers of the sheets are entangled and fastened with each other by being pressed further. That is, the sheets binding process is carried out by deforming and fastening the sheets by rocking the upper arm 1029 and by engaging and pressing the sheets by the upper teeth 10210 of the upper arm 1029 and the lower teeth 10214 of the lower arm 10212.

Here, the abovementioned finisher control portion 220 controlling the operation of the staple-less binding unit 102 detects a cam position at first by a sensor not shown in performing the staple-less binding operation on the sheets. Then, in receiving the sheets before performing the staple-less binding operation, the finisher control portion 220 controls the rotation of the staple-less binding motor M257 such that the cam 1027 is located at a bottom dead point (see FIG. TA). When the cam 1027 is located at the bottom dead point, a gap L2 is created between the upper teeth 10210 and the lower teeth 10214, thus enabling the sheet P to enter between them.

Meanwhile, during the binding operation, the staple-less binding motor M257 is rotated and the upper arm 1029 is rocked clockwise centering on an axis 10211 by the cam 1027. Then, when the cam 1027 is located at an upper dead point, the upper teeth 10210 of the upper arm 1029 and the lower teeth 10214 of the lower arm 10212 engage with each other (see FIG. 7B). The sheet bundle is pressed and convexities and concavities are formed thereon by the engagement operation of the upper and lower teeth 10210 and 10214, and the fibers of the sheets entangle with each other. Thereby, the sheets are linked and are fastened as a sheet bundle as a result.

When the cam 1027 rotates further after locating at the upper dead point, the roller 1028 can ride over the upper dead point of the cam 1027 as a deflection portion 1029*a* provided on the upper arm 1029 deflects. Still further, when the cam 1027 rotates further and reaches the bottom dead point again, a sensor not shown detects the cam 1027 and thereby, the finisher control portion 220 stops the rotation of the staple-less binding motor M257.

It is noted that the staple-less binding unit 102 of the present embodiment is configured such that a longitudinal direction (array direction of the pluralities of convexities and concavities) of the upper and lower teeth 10210 and 10214 is orthogonal to the width direction (substantially in parallel with the conveying direction A) (see FIG. 10 described later).

Next, the staple-less binding job (the control made by the finisher control portion 220) of the staple-less binding unit 102 will be explained with reference to FIGS. 10 through 12. FIGS. 10 and 11 illustrate the staple-less binding job of the first embodiment. It is noted that in FIGS. 10 and 11, the stapler 110 is not shown in order to clarify the explanation. FIG. 12 is a flowchart of the staple-less binding job of the first embodiment.

When the staple-less binding job is selected as a print job in Step S10, a force opposite from the conveying direction A is applied to the sheet P discharged by the discharge roller 103 by the paddle 106 and the rear end thereof is returned toward the rear end stopper 108. After that, the sheet P is returned in the direction opposite from the conveying direction A by the knuling belt 117 and the rear end of the sheet P is returned to the rear end stopper 108. Then, the alignment (correction) of the sheet P in a direction orthogonal to the conveying direction is made by holding the sheet (sheets) between the pair of aligning plates (pair of aligning members) 109 capable of aligning both ends of the sheets.

Figure 10A:
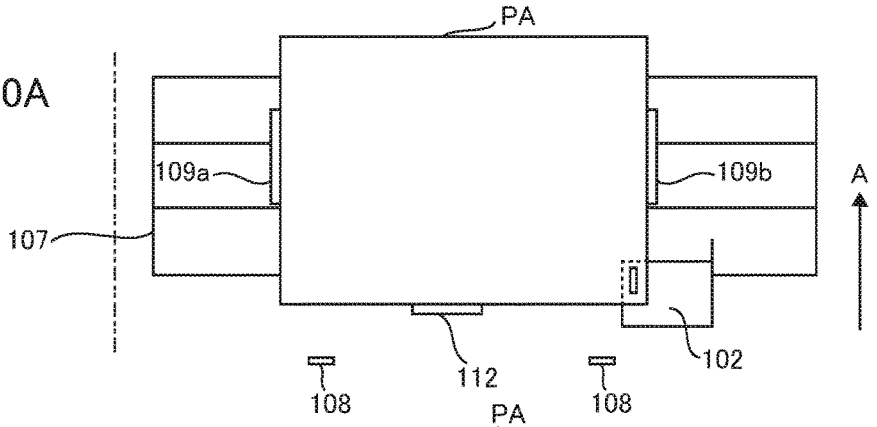
FIG. 10A is a schematic diagram illustrating a state in which a staple-less binding process has been carried out on the sheet bundle in a staple-less binding job.
Figure 10B:
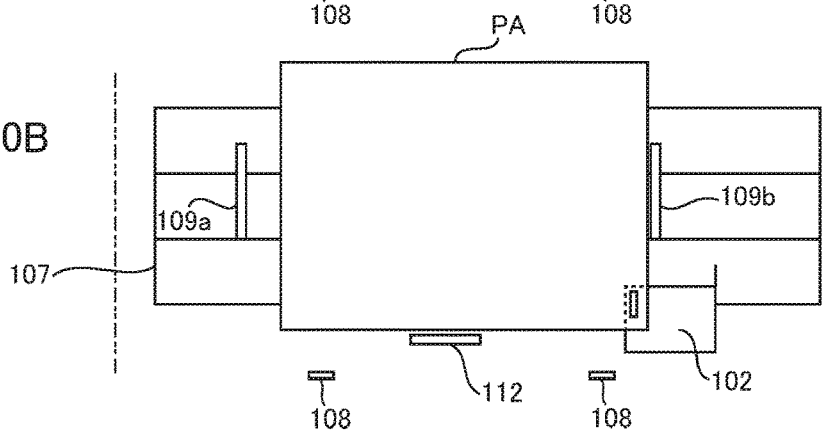
FIG. 10B is a schematic diagram illustrating a state in which the second aligning plate moves in a direction separating from the sheet bundle from the state shown in FIG. 10A.

When the aligning operation of each sheet P is carried out by a number of times of a required number of sheets of the sheet bundle PA to be staple-lessly bound, the sheet bundle PA thus aligned is moved to a binding position by the rear end assist 112. The staple-less binding operation of the staple-less binding unit 102 is carried out on the sheet bundle PA thus moved to the binding position in Steps S11 through S13. When the staple-less binding operation is executed, the rear end assist 112 as a restricting portion is moved in a direction separating from the rear end of the sheet bundle PA as shown in FIG. 10B in Step S14. In the same manner, the second aligning plates (second aligning member of the pair of aligning members) 109*a* in contact with one side surface (one end) of the sheet bundle PA is moved in a direction separating from one side surface of the sheet bundle PA in Step S15.

Figure 10C:
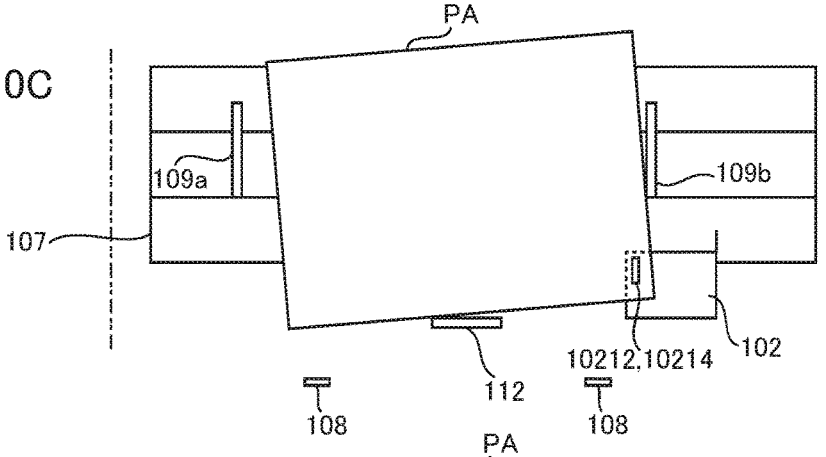
FIG. 10C is a schematic diagram illustrating a state in which the first aligning plate presses the sheet bundle toward the second aligning plate from the state shown in FIG. 10B.

When the second aligning plate 109*a* and the rear end assist 112 are separated from the sheet bundle PA, the first aligning plate (first aligning member of the pair of aligning members) 109*b* in contact with the other side surface (other end) of the sheet bundle PA is moved toward the second aligning plate 109*a* in Step S16 as shown in FIG. 10C. It is noted that the first aligning plate 109*b*, i.e., a moving member (moving portion), is disposed so as to face the second aligning plate 109*a*, i.e., a restricting member, on the processing tray.

If the sheet bundle PA bites into and is being inseparable from the upper or lower teeth 10210 or 10214 of the staple-less binding unit 102 at this time, the sheet bundle PA rotates centering on the upper or lower teeth 10210 or 10214 to which the sheet bundle PA bites as shown in FIG. 10C. The sheet bundle PA biting to the upper or lower teeth 10210 or 10214 is separated from the upper or lower teeth 10210 or 10214 by a rotational moment generated in the sheet bundle PA at this time.

In a case where the sheet bundle PA is not biting the upper or lower teeth 10210 or 10214 of the staple-less binding unit 102, the sheet bundle PA is pressed by the first aligning plate 109*b* and moves toward the second aligning plate 109*a* together with the first aligning plate 109*b*.

Figure 10D:
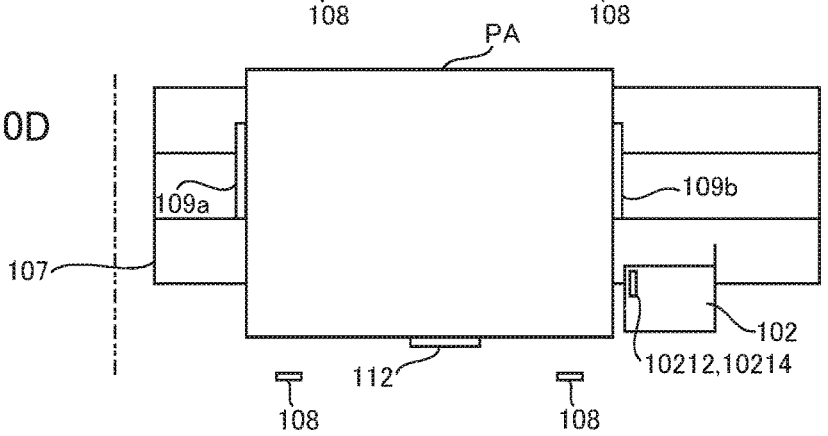
FIG. 10D is a schematic diagram illustrating a state in which a bite of binding teeth of the staple-less binding unit into the sheet bundle is released by pressing the sheet bundle by the first aligning plate.

As shown in FIG. 10D, the first aligning plate 109*b* is moved until when one side surface of the sheet bundle PA abuts against the second aligning plate 109*a* again and the other side surface of the sheet bundle PA abuts against the second aligning plate 109*a*. Thus, the sheet bundle PA is aligned again.

Figure 11A:
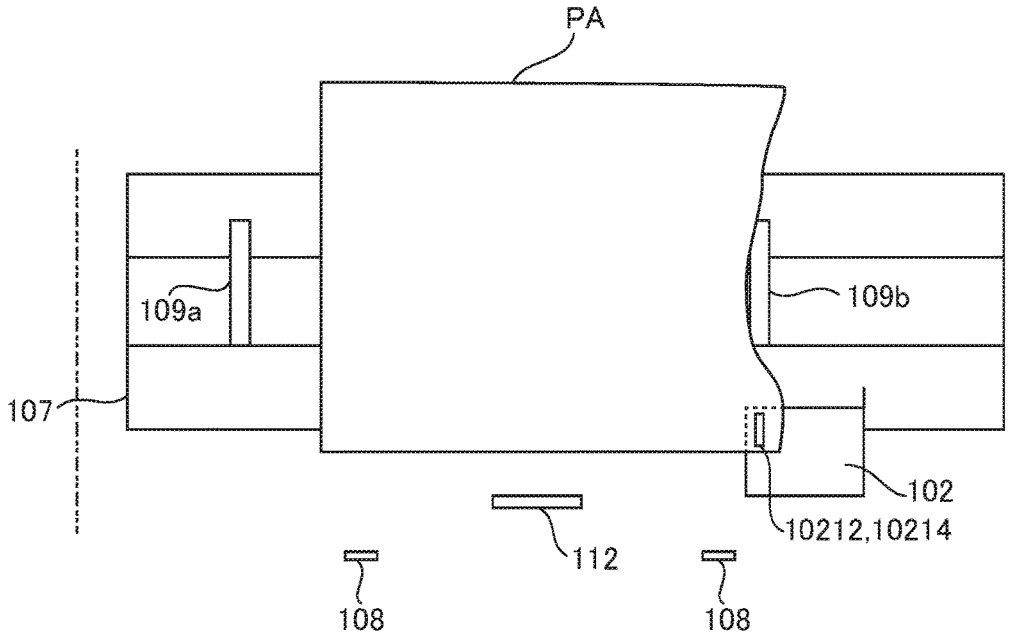
FIG. 11A is a schematic diagram illustrating a state in which the sheet bundle of thin sheets on which the staple-less binding process has been made is pressed in a width direction.
Figure 11B:
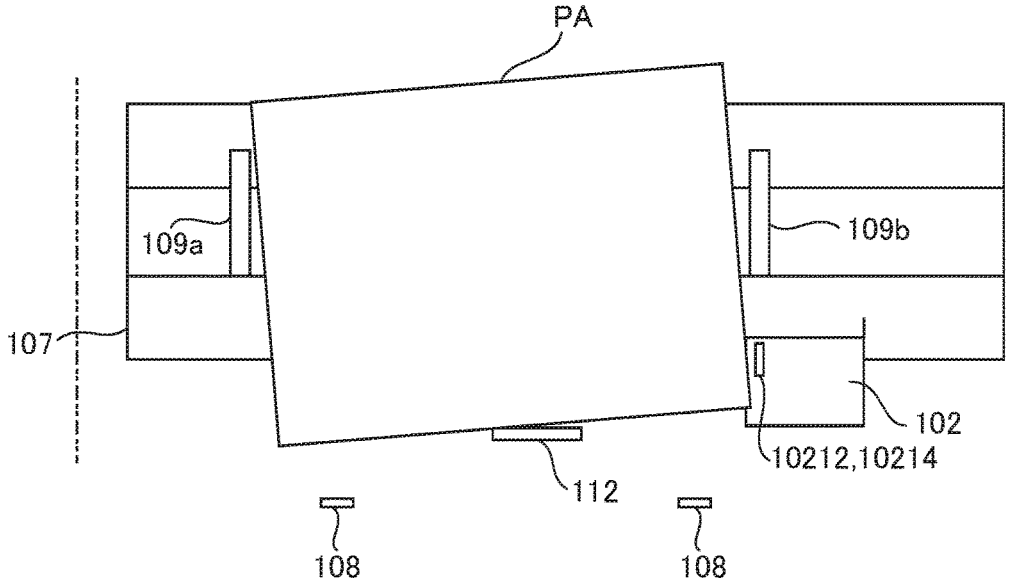
FIG. 11B is a schematic diagram illustrating a state in which the bite of the binding teeth of the staple-less binding portion to the sheet bundle of the thin sheets is released by a pressure of the first aligning plate pressing the sheet bundle in a width direction.
Figure 12:
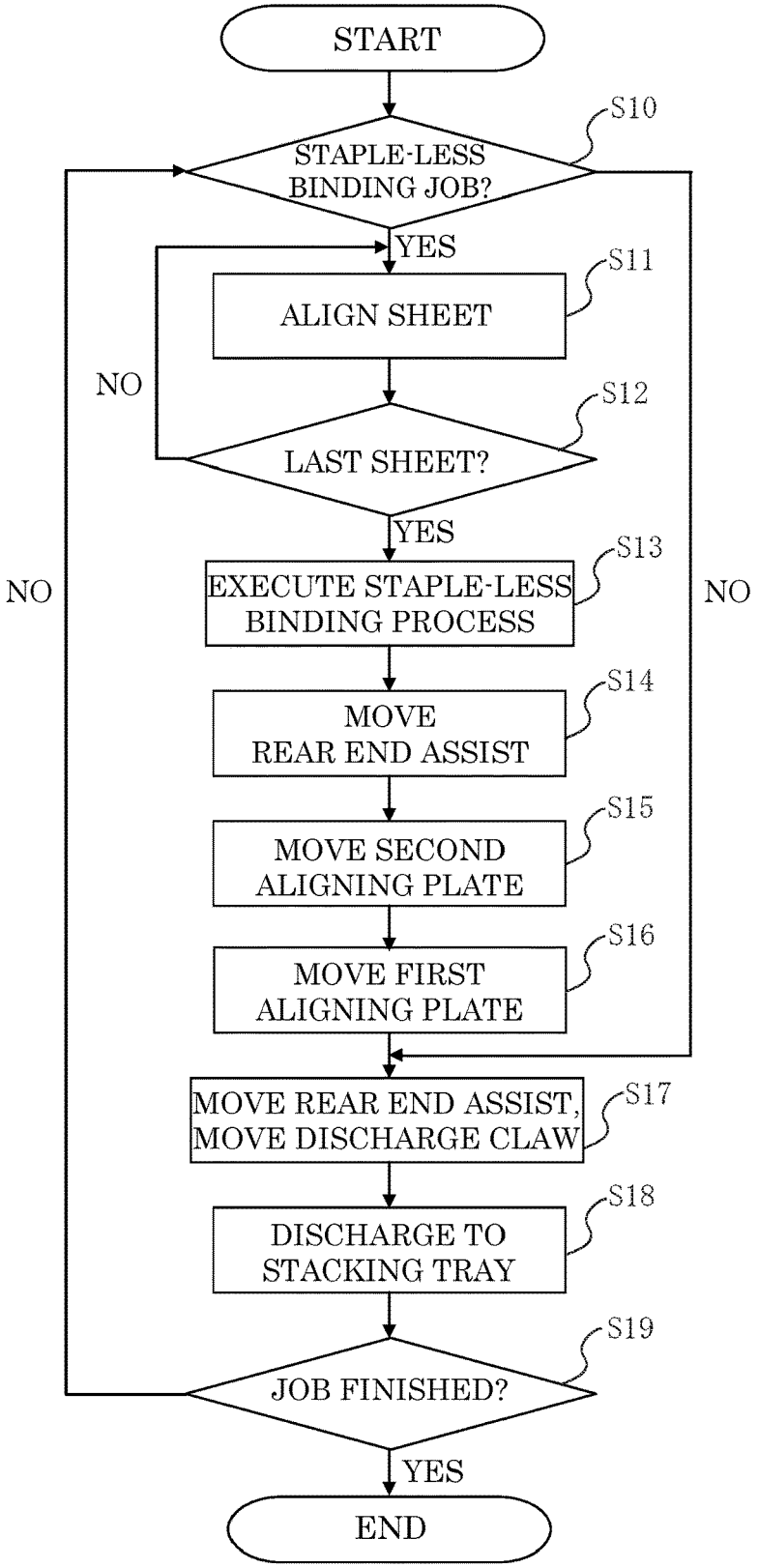
FIG. 12 is a flowchart of the staple-less binding job of the first embodiment.

In a case where the sheet P is a thin sheet here, the sheet bundle PA deflects as shown in FIG. 11A when the upstream end in the moving direction of the sheet bundle PA is pushed by the first aligning plate 109*b* in moving the first aligning plate 109*b* toward the second aligning plate 109*a*. This deflection is caused by a pressing force of the first aligning plate 109*b* pressing the sheet bundle PA and a force of the upper or lower teeth 10210 or 10214 biting the sheet bundle PA. When the first aligning plate 109*b* is moved further toward the second aligning plate 109*a* from this state, the force deflecting the sheet bundle PA (a force reacting the bite) caused by the pressure of the first aligning plate 109*b* surpasses the biting force of the sheet bundle PA and the biting force of the sheet bundle PA is released at once. Due to the force released at this time, the sheet bundle PA jumps out toward the second aligning plate 109*a* and separates from the first aligning plate 109*b* as shown in FIG. 11B. The second aligning plate 109*a* as an abutting portion abuts against a downstream end of the sheet bundle PA in a moving direction in which the first aligning plate 109*b* moves the sheet bundle PA. The second aligning plate 109*a* plays a role of receiving the sheet bundle PA jumped out at this time. That is, the second aligning plate 109*a* is an abutting portion abutting against a downstream end in the moving direction of the sheet bundle and restricts the move of the sheet bundle such that a distance of the sheet bundle separated from the first aligning plate 109*b* is kept to be less than a predetermined distance when the sheet bundle is moved by the first aligning plate 109*b*. Thereby, it is possible to prevent the sheet bundle PA from falling down from the processing tray 107 and from largely disturbing the stacking state of the sheet bundle PA.

When the sheet bundle PA is aligned again by the second aligning plate 109*a* and the first aligning plate 109*b*, the rear end assist 112 and the discharge claw 113 are driven to push the rear end of the sheet bundle PA and to discharge the sheet bundle PA to the stacking tray 114 in Steps S17 and S18. When the job is continuously carried out after that, the process returns to Start of the flowchart again and the processes in the flowchart are carried out. Meanwhile, in a case where the job ends, the job is finished here in Step S19.

As described above, the image forming apparatus 900 of the first embodiment drives the second aligning plate 109*a* and the first aligning plate 109*b* after performing the staple-less binding process by the staple-less binding unit 102 to move the sheet bundle PA from the binding position. Specifically, the sheet bundle PA is moved from the binding position by moving the second aligning plate 109*a* toward the first aligning plate 109*b* after separating the second aligning plate 109*a* from the sheet bundle PA. Therefore, even if the sheet bundle PA bites into the upper or lower teeth 10210 or 10214, the sheet bundle PA can be suitably separated from the upper or lower teeth 10210 or 10214. This arrangement makes it possible to prevent the sheet bundle PA from becoming an obstacle in conveying the sheet bundle PA to the stacking tray 114.

There is a possibility of damaging the sheet bundle PA when the sheet bundle PA is separated from the upper or lower teeth 10210 or 10214 if the sheet bundle PA is to be conveyed to the stacking tray 114 in the state in which the sheet bundle PA bites into the upper or lower teeth 10210 or 10214. This is also caused by the fact that the longitudinal direction of the upper and lower teeth 10210 and 10214 is substantially in parallel with the conveying direction to the stacking tray 114. However, it becomes easily possible to separate the sheet bundle PA from the upper or lower teeth 10210 or 10214 by moving the first aligning plate 109*b* in the width direction orthogonal to the longitudinal direction of the upper or lower teeth 10210 or 10214. This arrangement makes it possible to suppress the sheet bundle PA from being damaged.

Still further, because the image forming apparatus 900 of the first embodiment separates the rear end assist 112 from the rear end of the sheet bundle PA before when the first aligning plate 109*b* is moved toward the second aligning plate 109*a*. This arrangement makes it possible to generate the rotational moment in the sheet bundle PA centering on the upper or lower teeth 10210 or 10214 in pressing the side surface of the sheet bundle PA by the first aligning plate 109*b*. Thereby, the sheet bundle PA can be suitably separated from the upper or lower teeth 10210 or 10214.

Still further, the image forming apparatus 900 of the first embodiment causes the pair of aligning plates 109 to perform the abovementioned separating operation. Therefore, even if the sheet bundle PA suddenly moves in the direction orthogonal to the conveying direction when the sheet bundle PA is separated from the teeth by the first aligning plate 109*b*, the second aligning plate 109*a* exists at the place where the sheet bundle PA is moved, it is possible to prevent the sheet bundle PA from falling down from the processing tray 107.

Second Embodiment

Figure 13A:
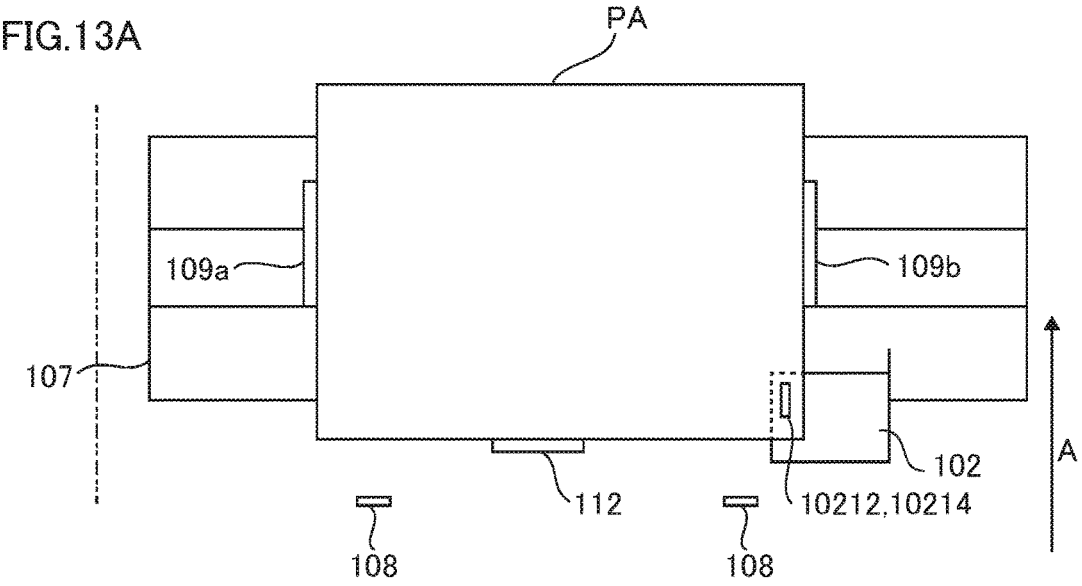
FIG. 13A is a schematic diagram illustrating a state in which a staple-less binding job of a second embodiment has been made.
Figure 13B:
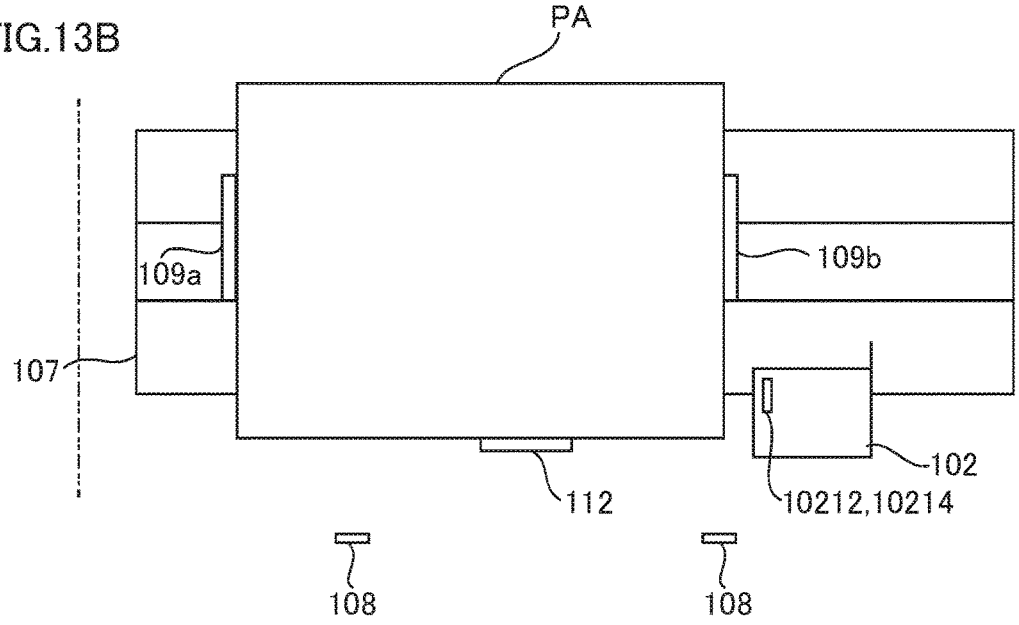
FIG. 13B is a schematic diagram illustrating a state in which the first and second aligning plates are moved in the width direction from the state shown in FIG. 13A.
Figure 14:
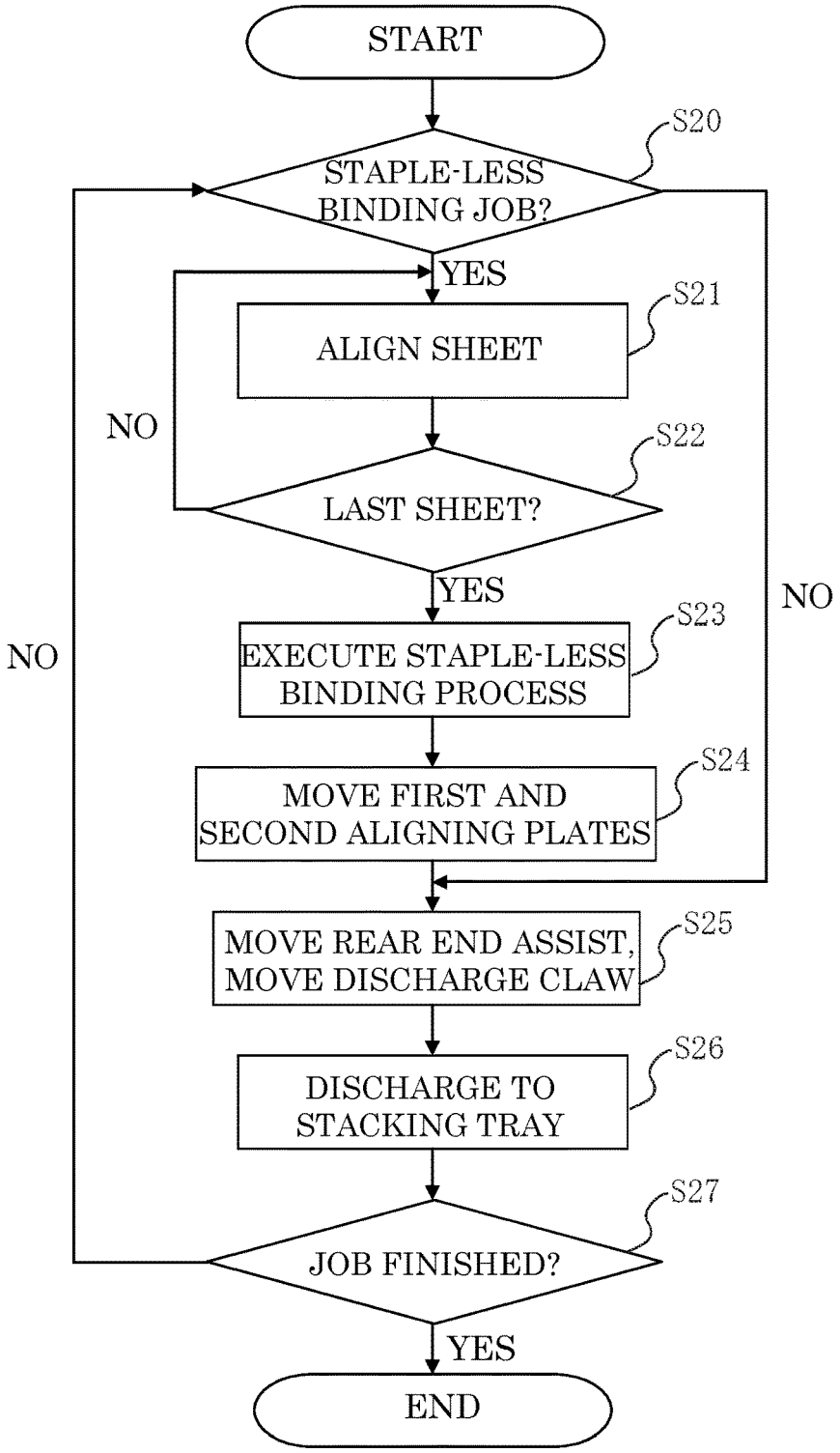
FIG. 14 is a flowchart of the staple-less binding j of the second embodiment.

Next, a second embodiment of the present invention will be explained with reference FIGS. 13 and 14. The second embodiment is different from the first embodiment in the drive control of the pair of aligning plates 109 made by the finisher control portion 220 after finishing the staple-less binding process. Therefore, the drive control of the pair of aligning plates 109 made by the finisher control portion 220 after finishing the staple-less binding process will be mainly explained and an explanation of the components and others of the image forming apparatus 900 will be omitted here. FIGS. 13A and 13B are schematic diagrams illustrating the staple-less binding job of the second embodiment, and FIG. 14 is a flowchart of the staple-less binding job of the second embodiment.

Because the processes from the selection of the staple-less binding job in the print job until when the staple-less binding job is executed are the same with those in the first embodiment, an explanation of the processes in Steps S20 through S23 will be omitted here. When the staple-less binding job is executed, then the pair of aligning plates 109 is moved in the direction orthogonal to the conveying direction A while keeping a distance between them (in the alignment state shown in FIG. 13A), and the sheet bundle PA is moved from the binding position (see Step S24 and FIG. 13B). Thereby, even in a case where the sheet bundle PA bites into and is inseparable from the upper or lower teeth 10210 or 10214, the sheet bundle PA is separated from the upper or lower teeth 10210 or 10214.

When the sheet bundle PA is moved from the binding position, the rear end assist 112 and the discharge claw 113 are driven to push the rear end of the sheet bundle PA and to discharge the sheet bundle PA to the stacking tray 114 in Steps S25 and S26. After that, the process returns to Start of the flowchart again and the processes in the flowchart are carried out in a case where the job is carried out continuously. Meanwhile, in a case where the job ends, the job is finished here in Step S27.

As described above, the image forming apparatus 900 of the present embodiment moves the pair of aligning plates 109, i.e., the moving member and the restricting member, in the width direction orthogonal to the conveying direction A while keeping the distance between them (in the state in which the sheet bundle PA is aligned) to move the sheet bundle PA from the binding position. That is, the second aligning plate 109*a* restricts the move of the sheet bundle such that a distance of the sheet bundle separated from the first aligning plate 109*b* is kept to be less than a predetermined distance when the sheet bundle is moved by the first aligning plate 109*b*. More specifically, the second aligning plate 109*a* restricts the move of the sheet bundle such that the sheet bundle is not separated from the first aligning plate 109*b* in the second embodiment. Therefore, even if the sheet bundle PA bites into and is inseparable from the upper or lower teeth 10210 or 10214, the sheet bundle PA can be suitably separated from the upper or lower teeth 10210 or 10214.

Third Embodiment

Figure 15A:
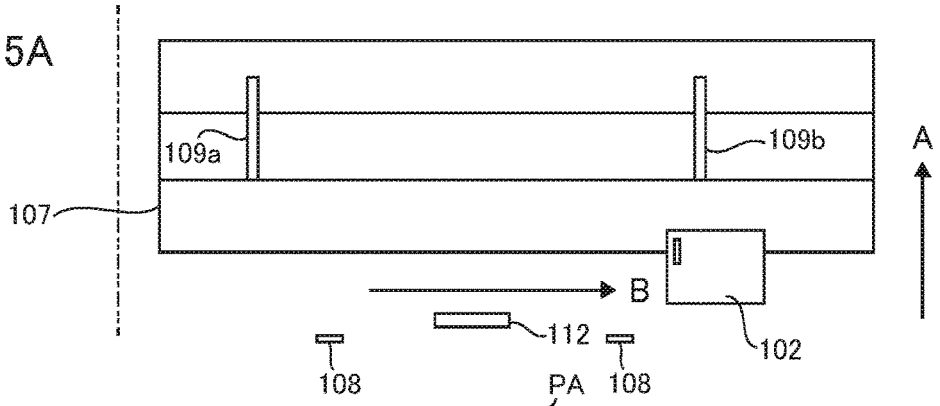
FIG. 15A is a schematic diagram illustrating a state in which the processing tray is inclined in the staple-less binding job of a third embodiment.
Figure 15B:
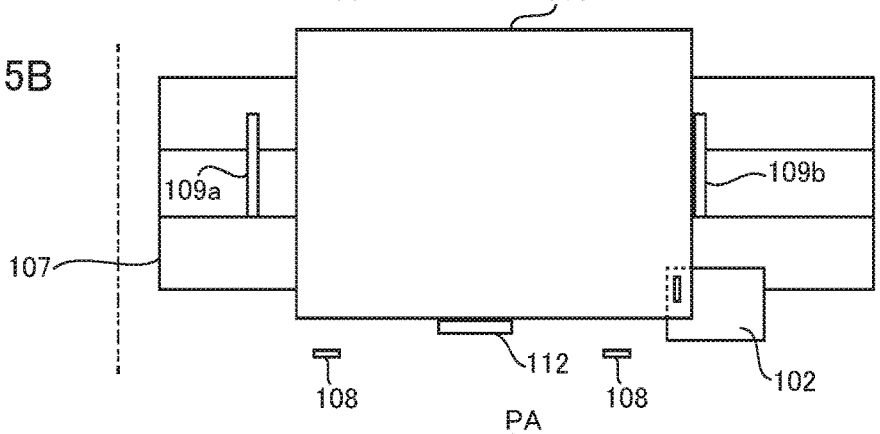
FIG. 15B is a schematic diagram illustrating a state in which the sheet bundle is formed on a binding position.
Figure 15C:
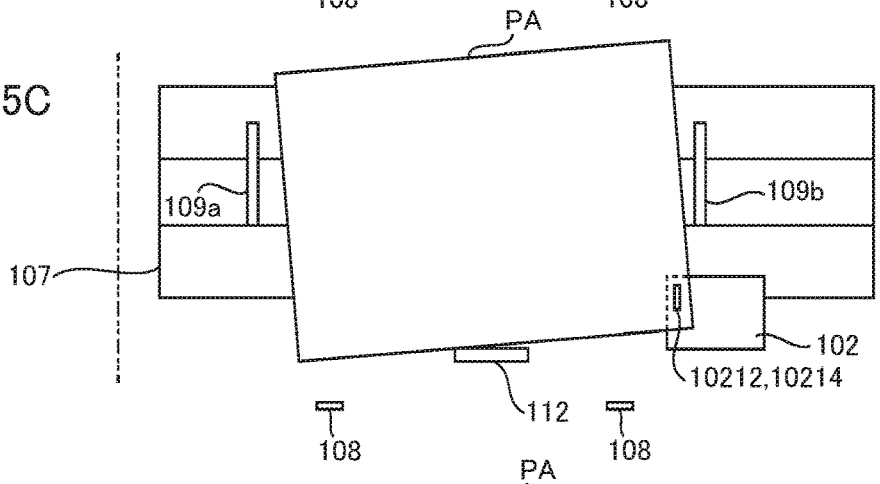
FIG. 15C is a schematic diagram illustrating a state in which the sheet bundle is pressed by the first aligning plate toward the second aligning plate after moving the rear end assist in the direction separating from the rear end of the sheet bundle.

Next, a third embodiment of the present invention will be explained with reference to FIGS. 15 and 16. The third embodiment is different from the first and second embodiments in the drive control of the pair of aligning plates 109 made by the finisher control portion 220 after finishing the staple-less binding process. Therefore, the drive control of the pair of aligning plates 109 made by the finisher control portion 220 after finishing the staple-less binding process will be mainly explained and an explanation of the components and others of the image forming apparatus 900 will be omitted here. It is noted that the processing tray 107 of the third embodiment is inclined downward in which the stacking surface 107*a* is inclined downward in a direction of an arrow B as shown FIG. 15A. FIGS. 15A through 15D are schematic diagrams illustrating the staple-less binding job of the third embodiment, and FIG. 16 is a flowchart of the staple-less binding job of the third embodiment.

When the staple-less binding job is selected in the print job in Step S30, a force in an inverse direction from the conveying direction A is applied to the sheet P discharged by the discharge roller 103 by the paddle 106 and the rear end of the sheet P is returned toward the rear end stopper 108. On a way in which the rear end of the sheet P is returned toward the rear end stopper 108, the sheet P moves by its own weight until when a side surface thereof abuts against the first aligning plate 109*b* along the inclination of the processing tray 107.

The correction of the sheet P in the width direction orthogonal to the conveying direction is made by the move of the sheet P by its own weight, and after that, the return to the rear end stopper 108 in the conveying direction A is carried out by the knuling belt 117 in Step S31. When the operation of aligning each sheet P has been carried out by a number of times of a required number of sheets of the sheet bundle PA to be staple-lessly bound as shown in FIG. 15C, the aligned sheet bundle PA is moved to a predetermined binding position by the rear end assist 112. When the aligned sheet bundle PA is moved to the predetermined binding position, the staple-less binding job is executed by the staple-less binding unit 102 to the sheet bundle PA moved to the binding position in Steps S32 and S33.

When the staple-less binding job is executed, then, the rear end assist 112 is moved in the direction separating from the rear end of the sheet bundle PA as shown in FIG. 15C in Step S34. When the move of the rear end assist 112 is completed, the first aligning plate 109*b*, i.e., the moving member, is moved in a direction opposite from an arrow B shown in FIG. 15A while facing the second aligning plate 109*a*, i.e., a restricting member, in Step S35. At this time, if the sheet bundle PA bites into and inseparable from the upper or lower teeth 10210 or 10214, the sheet bundle PA is rotated centering on the upper or lower teeth 10210 or 10214 to which the sheet bundle PA bites as shown in FIG. 15C. Due to a rotational moment generated at this time, even if the sheet bundle PA bites into the upper or lower teeth 10210 or 10214, the sheet bundle PA biting into the upper or lower teeth 10210 or 10214 can be separated from the upper or lower teeth 10210 or 10214.

It is noted that in a case where the sheet bundle PA is not biting into the upper or lower teeth 10210 or 10214 of the staple-less binding unit 102, the sheet bundle PA is pressed by the first aligning plate 109*b* and moves toward the second aligning plate 109*a* together with the first aligning plate 109*b*.

Figure 15D:
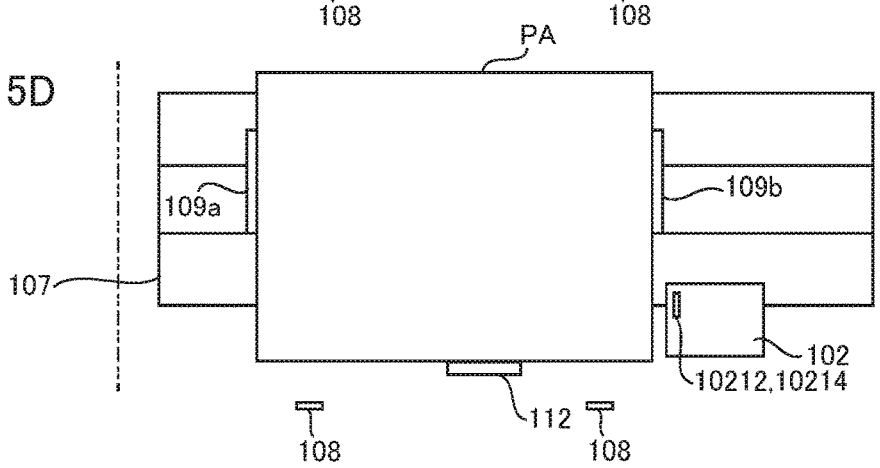
FIG. 15D is a schematic diagram illustrating a state in which the bite of the binding teeth of the staple-less binding unit to the sheet bundle is released.
Figure 16:
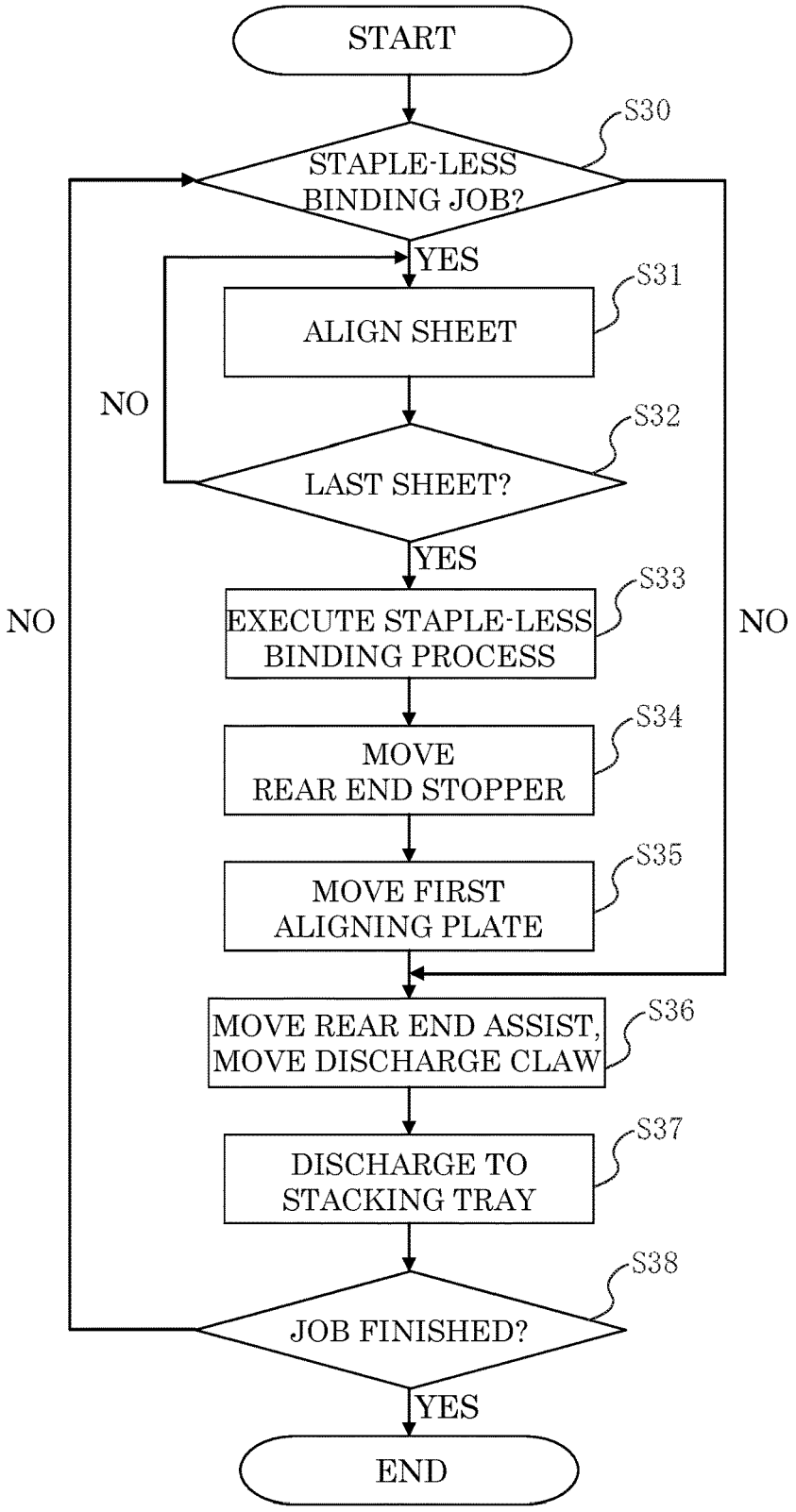
FIG. 16 is a flowchart of the staple-less binding job of the third embodiment.

The first aligning plate 109*b* moves until when the side surface of the sheet bundle PA abuts against the second aligning plate 109*a* again as shown in FIG. 15D, and the sheet bundle PA is aligned as the side surface of the sheet bundle PA abuts against the second aligning plate 109*a*.

When the sheet bundle PA is aligned by the second and first aligning plates 109*a* and 109*b*, the rear end assist 112 and the discharge claw 113 are driven to push the rear end of the sheet bundle PA and to discharge the sheet bundle PA to the stacking tray 114 in Steps S36 and S37. After that, the process returns to Start of the flowchart again and the processes in the flowchart are carried out in a case where the job is carried out continuously. Meanwhile, in a case where the job ends, the job is finished here in Step S38.

As described above, according to the third embodiment, the processing tray 107 is inclined downward in the direction of the arrow B as shown in FIG. 15A, and the first aligning plate 109*b* is driven to move the sheet bundle PA from the binding position. This arrangement makes it possible to suitably separate the sheet bundle PA from the upper or lower teeth 10210 or 10214 after the staple-less binding process even if the sheet bundle PA bites into and is being inseparable from the upper or lower teeth 10210 or 10214.

While embodiments of the present invention have been described above, the present invention is not limited the embodiments described above. Still further, the advantageous effects described in the embodiments of the present invention are merely a numeration of the most suitable effects and effects of the present invention are not limited to those described in the embodiments of the present invention.

For instance, while the configuration in which the first aligning plate 109*b* is moved widthwise toward the second aligning plate 109*a* to move the bound sheet bundle from the binding position has been explained in the embodiments described above, the present invention is not limited to such configuration. The present invention is applicable also to a configuration in which the bound sheet bundle is moved from the binding position to the conveying direction as another embodiment of the invention. For instance, the stapler-lessly bound sheet bundle PA may be separated from the upper and lower teeth 10210 or 10214 by moving the sheet bundle PA in the conveying direction toward the rear end stopper 108, i.e., the restricting member, by the knurling belt 117, i.e., the moving member.

Still further, while the present embodiment has been arranged such that the CPU of the finisher control portion 220 mounted in the finisher 100 controls the finisher 100, it is also possible to control the finisher 100 directly by the CPU circuit portion 200 included in the image forming apparatus 900. Still further, the CPU may be a CPU in an information instrument such as a separate personal computer, and the CPU controlling the finisher 100 is always need not be provided in the finisher 100. In a case where the CPU is provided in another information instrument, signals are transmitted/received through telecommunication lines and others (regardless wire or wireless communication) to make various controls. Such aspect is applicable not only to the CPU, but also to the other RAM, ROM and others.

Still further, while image forming apparatus of the present embodiment has been explained by using the electro-photographic type image forming process, the present invention is not limited to that. For instance, the type may be one which uses an ink-jet type image forming process of forming an image on a sheet P by discharging ink droplets from a nozzle.

Figure 17A:
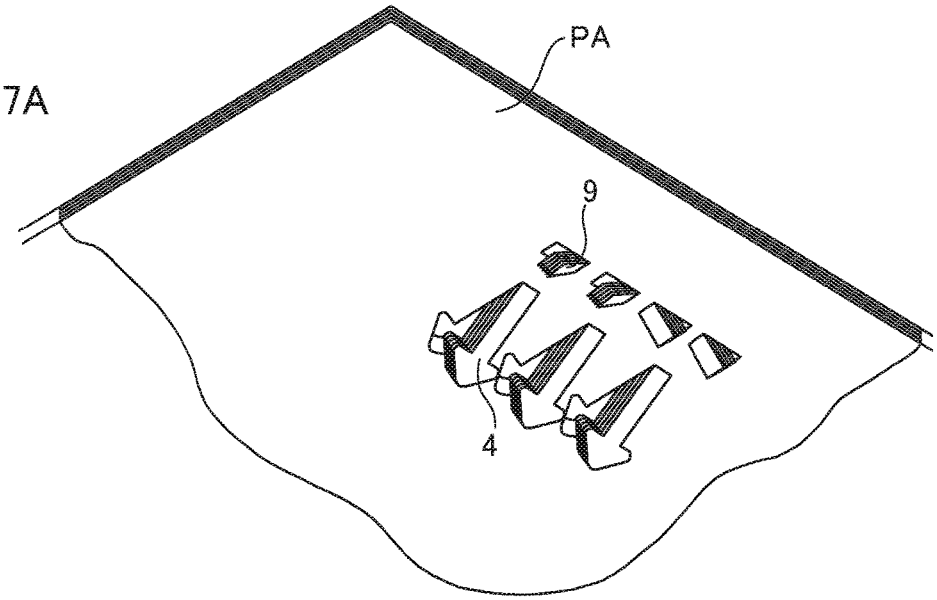
FIG. 17A is a schematic diagram showing a sheet bundle through which half-punched binding portion is formed by the staple-less biding unit.
Figure 17B:
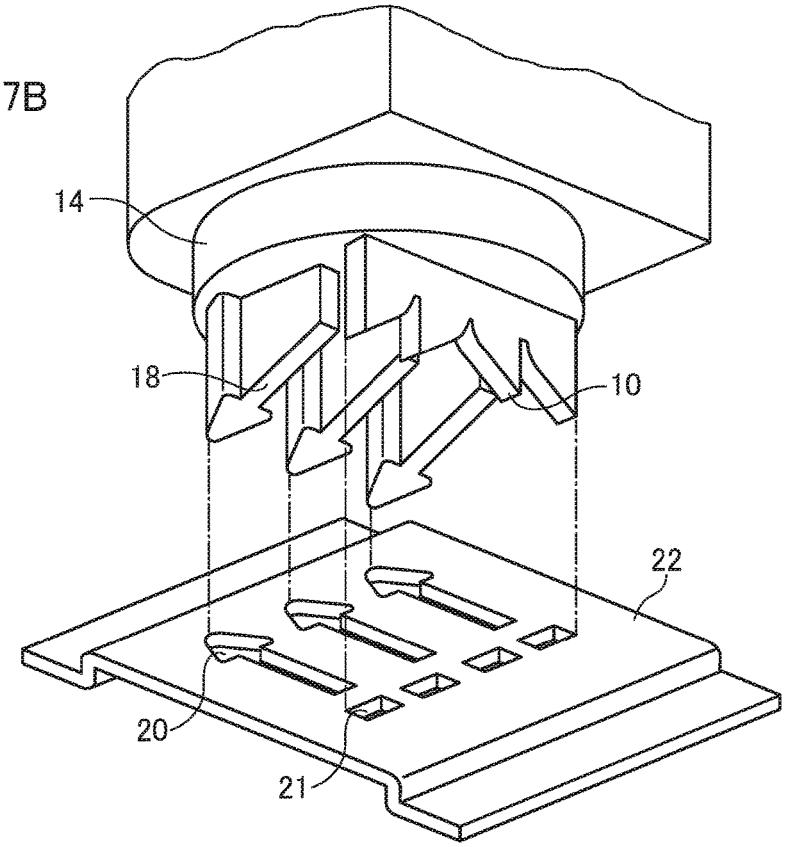
FIG. 17B is a schematic diagram showing binding teeth (dies and punches) of the staple-less biding unit forming the half-punched binding portion shown in FIG. 17A.

Still further, while a method of binding a sheet bundle by forming the convexities and concavities by engaging the upper and lower teeth has been used to explain the stapler-less binding process in the embodiments described above, the present invention is not limited to that. The present invention is applicable also to a case where a sheet bundle is bound by forming a half-punched shape by using a half-punching binding portion and by engaging upper and lower teeth. For instance, the present invention may be used in a binding portion performing the half-punch binding process by forming half-punched portions 4 and 9 by biting a sheet bundle PA by punching tooth 10 and 18 of an upper tooth 14 and punched holes 20 and 21 of a lower tooth 22 as shown in FIG. 17. In this case, even if the half-punched portions 4 and 9 are hooked (corresponds to the 'bite') by the punch holes 20 and 21, the sheet bundle PA becomes movable by moving the pair of aligning plates 109*a* and 109*b*. The staple-less binding unit as the binding portion may have any configuration as long as the staple-less binding binds a plurality of sheets stacked on the sheet stacking portion as a bundle by deforming the sheets.

Still further, while the first aligning plate 109*b* has been moved after moving the rear end assist 112 in the first embodiment, the sheet bundle PA may be moved from the binding position by moving the first aligning plate 109*b* without moving the rear end assist 112.

While the present invention has been described with reference to the exemplary embodiments, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2013-138108, filed on Jul. 1, 2013, which is hereby incorporated by reference herein in its entirety.

What is claimed is:

1. A sheet processing apparatus comprising:

a sheet supporting portion configured to support a sheet bundle;

a binding portion configured to bind the sheet bundle supported on the sheet supporting portion by deforming a binding position of the sheet bundle without employing a staple; and a moving portion configured to move in a movement direction while contacting with an end of the sheet bundle bound by the binding portion so that the sheet bundle rotates and detaches from the binding portion, the moving portion contacting with the end of the sheet bundle at least at a region on an opposite side from the binding position with respect to a centroid of the sheet bundle in a direction orthogonal to the movement direction.

2. The sheet processing apparatus according to claim 1, wherein the bound sheet bundle rotates about the binding position with a movement of the moving portion.

3. The sheet processing apparatus according to claim 2, wherein the binding position is a corner portion of the sheet bundle.

4. The sheet processing apparatus according to claim 1, wherein the binding position is a corner portion of the sheet bundle.

5. The sheet processing apparatus according to claim 1, wherein the binding position is a corner portion of the sheet bundle where a first end and a second end orthogonal to the first end intersect each other, and the moving portion pushes the first end of the sheet bundle.

6. The sheet processing apparatus according to claim 1, wherein each of the plurality of the sheets is a fibrous sheet, and wherein the binding portion binds the plurality of sheets by entangling fibers of the respective sheets by biting the plurality of sheets.

7. The sheet processing apparatus according to claim 1, wherein the binding portion binds the plurality of sheets by half-punching the plurality of sheets.

8. The sheet processing apparatus according to claim 1, further comprising a restricting member configured to restrict a position of the sheet bundle by contacting with a second end, orthogonal to a first end, of the sheet bundle, wherein the restricting member separates from the second end of the sheet bundle before the moving portion starts to move while contacting with the first end of the sheet bundle.

9. The sheet processing apparatus according to claim 8, wherein the restricting member restricts the rotation of the sheet bundle by contacting with the second end of the sheet bundle.

10. The sheet processing apparatus according to claim 1, wherein the moving portion contacts an end of the sheet bundle by contacting a first end of the sheet bundle, the sheet processing apparatus further comprises a restricting member configured to restrict a position of the sheet bundle by contacting with a second end, orthogonal to the first end, of the sheet bundle, the binding position is a corner portion of the sheet bundle where the first end and the second end intersect each other, and the restricting member contacts with the second end of the sheet bundle when the binding portion binds the sheet bundle, and separates from the second end of the sheet bundle before the moving portion starts to move while contacting with the first end of the sheet bundle.

11. The sheet processing apparatus according to claim 1, wherein the moving portion contacts an end of the sheet bundle by contacting a first end of the sheet bundle, the sheet processing apparatus further comprises a restricting member configured to restrict a position of the sheet bundle by contacting with a second end, orthogonal to the first end, of the sheet bundle, and the moving portion moves while contacting with the first end of the sheet bundle in a state that the restricting member is separated from the second end of the sheet bundle.

12. An image forming apparatus comprising:

an image forming portion configured to form an image on a sheet;

a sheet supporting portion configured to support a sheet bundle including the sheet on which the image is formed by the image forming portion;

a binding portion configured to bind the sheet bundle supported on the sheet supporting portion by deforming a binding position of the sheet bundle without employing a staple; and a moving portion configured to move in a movement direction while contacting with an end of the sheet bundle bound by the binding portion so that the sheet bundle rotates and detaches from the binding portion, the moving portion contacting with the end of the sheet bundle at least at a region on an opposite side from the binding position with respect to a centroid of the sheet bundle in a direction orthogonal to the movement direction.

* * * * *